US005563568A

United States Patent [19]

Sasaki et al.

[11] Patent Number: 5,563,568

[45] Date of Patent: Oct. 8, 1996

[54] MAGNETIC FIELD GENERATING APPARATUS FOR GENERATING IRRATIONAL-ORDER-HARMONIC WAVES FOR USE IN AN UNDULATOR

[75] Inventors: Shigemi Sasaki; Shinya Hashimoto, both of Ibaraki-ken, Japan

[73] Assignee: Japan Atomic Energy Research Institute, Tokyo, Japan

[21] Appl. No.: 562,636

[22] Filed: Nov. 27, 1995

Related U.S. Application Data

[63] Continuation of Ser. No. 499,911, Jul. 11, 1995, abandoned.

[30] Foreign Application Priority Data

Jul. 15, 1994 [JP] Japan ..... 6-164361

[51] Int. Cl.[6] ..... H01F 7/02

[52] U.S. Cl. ..... 335/306; 335/210; 315/5.35; 372/2

[58] Field of Search ..... 335/210–214, 335/302–306; 250/396 ML; 315/5.34, 5.35; 372/2

[56] References Cited

PUBLICATIONS

S. Hashimoto et al, "A Concept of a New Undulator That Will Generate Irrational Higher Harmonics in Synchrotron Radiation", Japan Atomic Energy Research Institute, JAERI–M 94–055, Mar. 1994, pp. 1–27.

*Primary Examiner*—Leo P. Picard
*Assistant Examiner*—Raymond M. Barrera
*Attorney, Agent, or Firm*—Banner & Allegretti, Ltd.

[57] ABSTRACT

A plurality of magnetic poles provided by using magnets are arranged in opposition to one another in pairs. The pairs of magnetic poles are arranged with two kinds of intervals between the adjacent magnetic poles. The two intervals have the relation of an irrational number ratio in accordance with the lining order of generalized Fibonacci series. The series of peak values of the magnetic field or the series of peak values of the double integral values of the magnetic field along the central axis of the magnetic circuit comprising the array of the magnets reside at the positions to satisfy the relation of generalized Fibonacci series.

2 Claims, 16 Drawing Sheets

TYPE 3

MAGNETIC FIELD GENERATING APPARATUS FOR GENERATING IRRATIONAL-ORDER-HARMONIC WAVES FOR USE IN AN UNDULATOR

This application is a continuation of application Ser. No. 08/499,911, filed Jul. 11, 1995, now abandoned.

BACKGROUND OF THE INVENTION

1. Field of the Invention

The present invention relates to a magnetic field generating apparatus for use in an undulator as an insertion light source adapted to generate radiation.

2. Description of Prior Art

An undulator according to a prior art which has been used for generating radiation of high brilliance is adapted to generate radiation by causing electrons to travel in a zigzag manner in a periodic magnetic field provided by arranging magnets periodically.

According to the method as mentioned above, it is not possible in principle to avoid generation of integer-order-harmonic waves. In general, in applications of undulators radiation from the undulator is used in combination with a monochromator in order to utilize monochromatic radiation having high brilliance. However, according to the method, harmonic light cannot be removed. Intrusion of such harmonic light is quite detrimental to studies with the use of the radiation. Thus, development of a method to effectively remove such harmonic light has been desired.

SUMMARY OF THE INVENTION

An object of the present invention is to provide a magnetic field generating apparatus for use in an undulator as an insertion light source, adapted not to generate hazardous integer-order-harmonic waves.

To attain the object, according to the present invention, a magnetic field generating apparatus for use in an undulator as an insertion light source, wherein: a plurality of magnetic poles provided by using magnets are arranged in opposition to one another in pairs, said pairs of magnetic poles of the array of magnets are arranged with two kinds of intervals between the adjacent magnetic poles, said two intervals having the relation of an irrational number ratio in accordance with the order of substantially generalized Fibonacci series; and the series of peak values of the magnetic field or the series of peak values of the double integral of the field along the central axis of the magnetic circuit comprising of the array of the magnets reside at the positions so as to satisfy the order in substantially generalized Fibonacci series.

The present invention has introduced a novel concept of quasi-period in the magnetic circuit of an undulator and is capable of realizing an undulator which generates only irrational-order-harmonic waves but does not generate hazardous integer-order-harmonic waves.

Accordingly, a monochromatic light of high brilliance which is not contaminated with higher order harmonics can be supplied by combining the above-mentioned quasi-periodic undulator with a monochromator.

BRIEF DESCRIPTION OF THE DRAWINGS

The above and other objects and features of the invention will become more obvious hereinafter with the following description on the accompanying drawings, wherein.

DESCRIPTION OF THE PREFERRED EMBODIMENTS

Figure 1:
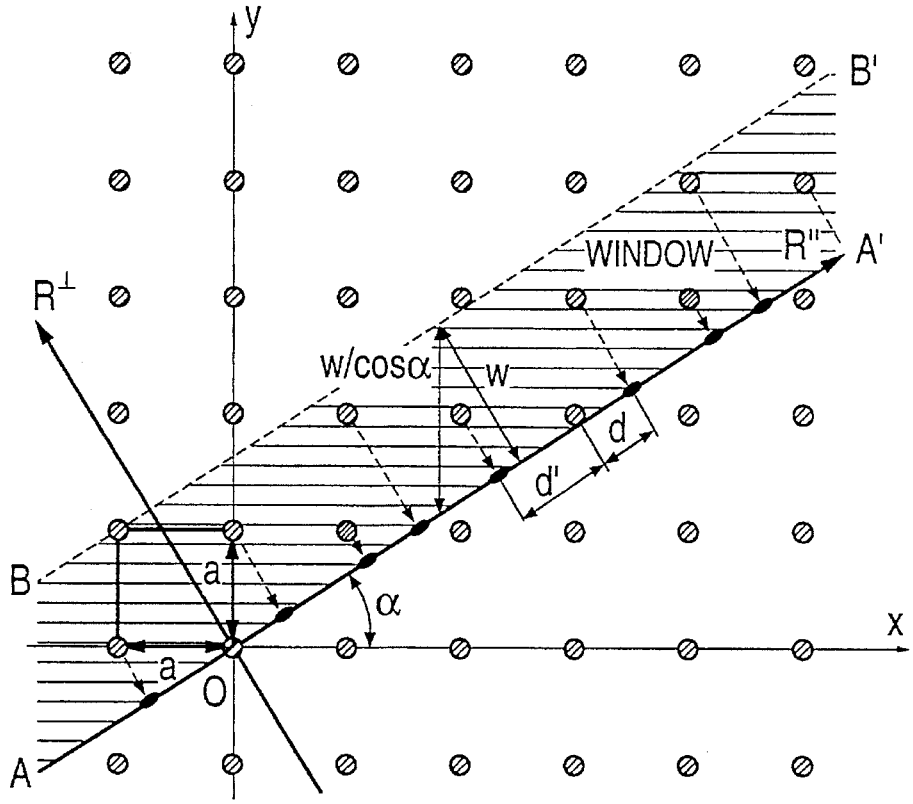
FIG. 1 illustrates a creation of a one-dimensional quasi-periodic lattice from a two-dimensional (2D) square lattice.

The inventors have introduced a novel concept of the quasi-period in the magnetic circuit of the undulator and found that an undulator which does not generate integer-order harmonics can be realized. This undulator comprises a magnetic circuit in which the magnets are arranged according to the order of Fibonacci series which has been generalized with two kinds of magnet intervals having the relation of an irrational number ratio, and the radiation emitted by this apparatus generates only irrational-order-harmonic waves. Accordingly, a monochromatic light of high brilliance which is not contaminated by light of high order harmonics can be supplied by combining the quasi-periodic undulator with a monochromator.

A new concept which will be introduced to the magnetic circuit of an undulator for the purpose of generating irrational-order-harmonic waves of radiation will firstly be explained.

Conventional sources for synchrotron radiation generate X-ray photons with a wide band of energy or with strong higher harmonics. Silicon crystal is properly used for monochromating the radiation, which simultaneously reflects (or diffract) some higher harmonics through the same lattice planes. The higher harmonics of radiation are generally harmful in experiments and are usually removed by use of total reflection mirrors characterized by a critical angle depending on the radiation energy and atomic weight of mirror-materials. In some cases, a double crystal monochromator is detuned to eliminate the higher harmonics by taking advantage of narrower Darwin curves for the higher order reflections. In the third generation facilities of synchrotron radiation, the accelerating voltage of electrons is raised up to 6–8 GeV and very high photon energies will be actively used. The conventional ways to get rid of the higher harmonics must be unsuitable or useless in such high energy usages, because of a very small critical angle of total reflection and a very narrow angular width of the Darwin curve even of the first harmonic.

For the same purpose as described above, recently, an undulator to suppress the higher harmonics by adding a horizontal magnetic field has been reported. From a completely different viewpoint, the present invention provides an undulator never generating rational higher harmonics but irrational ones that are never diffracted in the same orientation of monochromator crystals. The inventors' idea originates in the diffraction property of the quasi-periodic lattices. The inventors have noted that the analogy between the following two equations:

1) X-ray intensity from a one-dimensional scatterer with electron density of $\rho(r)$;

$$I(q)=\left|\int_{-\infty}^{\infty}\rho(r)\exp(-2\pi iqr)dr\right|^2 \tag{1}$$

2) Spectral-angular intensity distribution from undulators;

$$\frac{d^2I}{dfd\Omega}=\left|\int_{-\infty}^{\infty}s(r_n)\exp\{-2\pi i(f/c)r_n\}dr_n\right|^2 \tag{2a}$$

$$S(r_n)=\left(\frac{[n\times(n-\dot{r}/c)\times\ddot{r}/c]}{(1-\dot{r}_n/c)^2}\right)\exp(-2\pi ift) \tag{2b}$$

-continued where $$r_n=n\cdot r. \tag{2c}$$

Time t, in eq. (2b) is usually known as "the retarded time" or "the emitter time". The eq. (2b) is expressed as a function of a distance along the lining direction of magnets, (n·r), (wherein the symbol "·" is the one representing an inner product). Here, it should be noted that the notations in these equations should be remarked, because the equivalence in the formulations are intended only to be shown.

The irrationality experienced in the quasi-periodic system is here extended to design a new undulator instead of the conventional ones with periodic arrays of magnets. To this end, creation of a quasi-periodic lattice will then described hereinbelow.

It is known that a quasi-periodic lattice causes sharp diffraction peaks irrationally spaced from each other in reciprocal space. Diffraction properties of the quasi-periodicity are now reviewed.

One of the most intuitive ways for creating quasi-periodic lattices is the projection method in which the lattice points on a higher dimensional periodic lattice are projected onto a lower dimensional general plane inclined with irrational gradients against the periodic lattice axes. This method is readily applied to design a configuration of the magnetic segments on an undulator and the properties of radiation. The inventors employ the projection method by starting with a simple square lattice to create a 1D quasi-periodic lattice for the sake of basic comprehension.

FIG. 1 is a diagram illustrating a creation of one-dimensional quasi-periodic lattice from a 2D square lattice. Specifically, FIG. 1 illustrates a two-dimensional (2D) regular (square) lattice with a cell parameter of a, in which shaded circles refer to scattering centers, for example, corresponding to atoms, molecules and so on, in crystals and scattering centers for electron in time domain on the insertion devices. The circles are positioned at the lattice points $(x_i, Y_i)$, which can be represented by integers in unit of a. A quasi-periodic lattice achieved on the AA'.

To produce a quasi-periodic array of centers, is first drawn a window, AA'B'B, inclined with a slope of tanα against the x axis, where tanα must be irrational. The inventors here adopt an irrational number, $1/\tau$, for tanα, where τ is known as the golden mean and frequently used in case of discussing alloy crystals with the icosahedral or decagonal quasi-periodic lattice;

$$\tau=\frac{\sqrt{5}+1}{2} \tag{3}$$

The inventors will start with this number to develop our model.

Supposing that the window be spanned with an axa square cell indicated by thick lines in FIG. 1, which has a width given by $$w=a(\sin\alpha+\cos\alpha), \tag{4}$$

$$\sin\alpha=\frac{1}{\sqrt{1+\tau^2}}, \tag{5a}$$

$$\cos\alpha=\frac{\tau}{\sqrt{1+\tau^2}}. \tag{5b}$$

The lattice points $(x_i, y_i)$'s included within the window are then projected onto the inclined axis, AA'. This axis will be referred to as "R" axis" and its normal as "$R^{\perp}$ axis". The coordinates of the lattice point $(x_i, Y_i)$ are related to $(R_i'', R_i^{\perp})$ as $$\begin{pmatrix} R_i'' \\ R_i^{\perp} \end{pmatrix} = \begin{pmatrix} \cos\alpha & \sin\alpha \\ -\sin\alpha & \cos\alpha \end{pmatrix} \begin{pmatrix} x_i \\ y_i \end{pmatrix}. \tag{6}$$

The lattice points in the window satisfy the following inequality;

$$0 \leqq R^{\perp} < w, \tag{7}$$

or in the xy system $$x \tan\alpha \leqq y < x \tan\alpha + a(1+\tan\alpha), \tag{8a}$$

using w/cos α=a(1+tan α), or $$\left(\frac{1}{\tau}\right) x \leqq y < \left(\frac{1}{\tau}\right) x + \tau a. \tag{8b}$$

The projected points align with two kinds of inter-site distances, $$d = a \sin\alpha, \tag{9a}$$

$$d' = a \cos\alpha \tag{9b}$$

having a ratio of $$\frac{d'}{d} = \frac{1}{\tan\alpha}. \tag{9c}$$

This is equal to τ(≈1.618 . . . ) in the present case, and the points are never positioned in a periodic fashion.

The projecting procedure mentioned above is next formulated. The lattice structure within the window is expressed by a function E(R) defined as $$E(R) = S(R)V(R) \tag{10}$$

$$R = (x, y), \tag{11a}$$

or $$R = (R'', R^{\perp}), \tag{11b}$$

where S(R) is the structure factor which represents the 2D regular lattice of N centers (N: a sufficiently large number) being expressed by $$S(R) = \sum_{i=1}^{N} \delta(R - R_i), \tag{12}$$

and V(R) the window function defined as $$V(R) = \begin{cases} 1, & \text{if } R \text{ is within the window,} \\ 0, & \text{otherwise} \end{cases} \tag{13a}$$

or $$V(R'', R^{\perp}) = \begin{cases} 1, & \text{for } 0 \leqq R^{\perp} < W, \\ 0, & \text{otherwise.} \end{cases} \tag{13b}$$

E(R) can also be represented in the (R", $R^{\perp}$) system. The projection of the lattice points onto the R" axis is mathematically expressed as $$P(R'') = \int_{-\infty}^{\infty} E(R'', R^{\perp}) dR^{\perp}. \tag{14}$$

Figure 2:
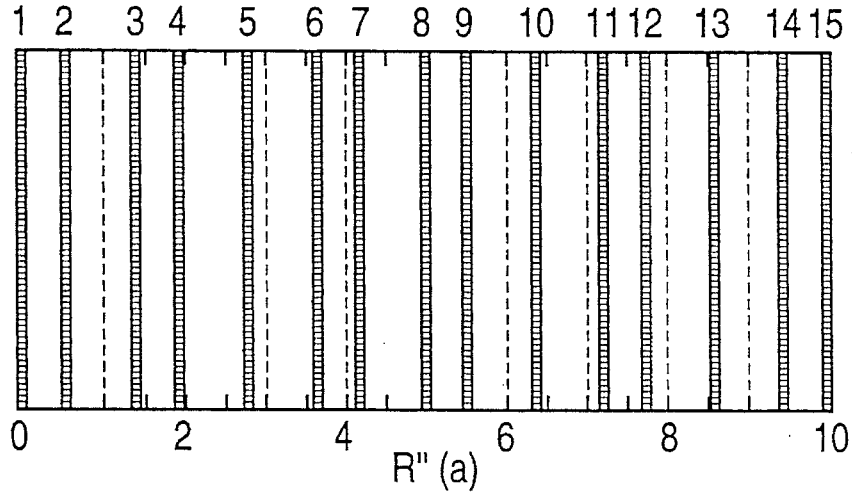
FIG. 2 illustrates a quasi-periodic arrangement of centers by bars.

This function P(R") represents a quasi-periodic array of centers on the R" axis. The positions of the lattice points and their projected coordinates are listed in Table 1 in unit of the cell parameter, a. Further, the distances between the neighboring points along the R" axis are given in the column of "Distance to next". FIG. 2 is a diagram illustrating a quasi-periodic arrangement of centers by bars. In the meantime, in FIG. 1, d' and d indicate the two kinds of distance between the quasi-lattice points, and d'=τd.

TABLE 1

| i | x(i) (a) | y(i) (a) | R"(i) (a) | $R^{\perp}$(i) (a) | Distance to next (a) |
|---|---|---|---|---|---|
| 1 | 0 | 0 | 0.0000 | 0.0000 | 0.5257 |
| 2 | 0 | 1 | 0.5257 | 0.8507 | 0.8507 |
| 3 | 1 | 1 | 1.3764 | 0.3249 | 0.5257 |
| 4 | 1 | 2 | 1.9021 | 1.1756 | 0.8507 |
| 5 | 2 | 2 | 2.7528 | 0.6498 | 0.8507 |
| 6 | 3 | 2 | 3.6034 | 0.1241 | 0.5257 |
| 7 | 3 | 3 | 4.1291 | 0.9748 | 0.8507 |
| 8 | 4 | 3 | 4.9798 | 0.4490 | 0.5257 |
| 9 | 4 | 4 | 5.5055 | 1.2997 | 0.8507 |
| 10 | 5 | 4 | 6.3562 | 0.7739 | 0.8507 |
| 11 | 6 | 4 | 7.2068 | 0.2482 | 0.5257 |
| 12 | 6 | 5 | 7.7326 | 1.0989 | 0.8507 |
| 13 | 7 | 5 | 8.5832 | 0.5731 | 0.8507 |
| 14 | 8 | 5 | 9.4339 | 0.0474 | 0.5257 |
| 15 | 8 | 6 | 9.9596 | 0.8981 | 0.8507 |
| 16 | 9 | 6 | 10.8102 | 0.3723 | 0.5257 |
| 17 | 9 | 7 | 11.3360 | 1.2230 | 0.8507 |
| 18 | 10 | 7 | 12.1866 | 0.6972 | 0.8507 |
| 19 | 11 | 7 | 13.0373 | 0.1715 | 0.5257 |
| 20 | 11 | 8 | 13.5630 | 1.0222 | 0.8507 |

Table 1 shows a list of the coordinates in unit of a appearing in creating a quasi-periodic lattice in case of a primitive square lattice. The inclination of the q" axis, tan α, is 1/τ and the width of window, w, is spanned by a single cell (axa).

In calculating the Fourier transform of P(R"), it is found that Fourier transform of a projected function is given by a cross-section of the Fourier transform of the original function before projection. First Fourier transform is effected for eq. (10) to obtain the following expression:

$$E(q) = S(q) * V(q), \tag{15}$$

where (*) stands for the convolution operation. E(q), S(q) and V(q) are the Fourier transforms of E(R), S(R) and V(R), respectively.

Figure 3:
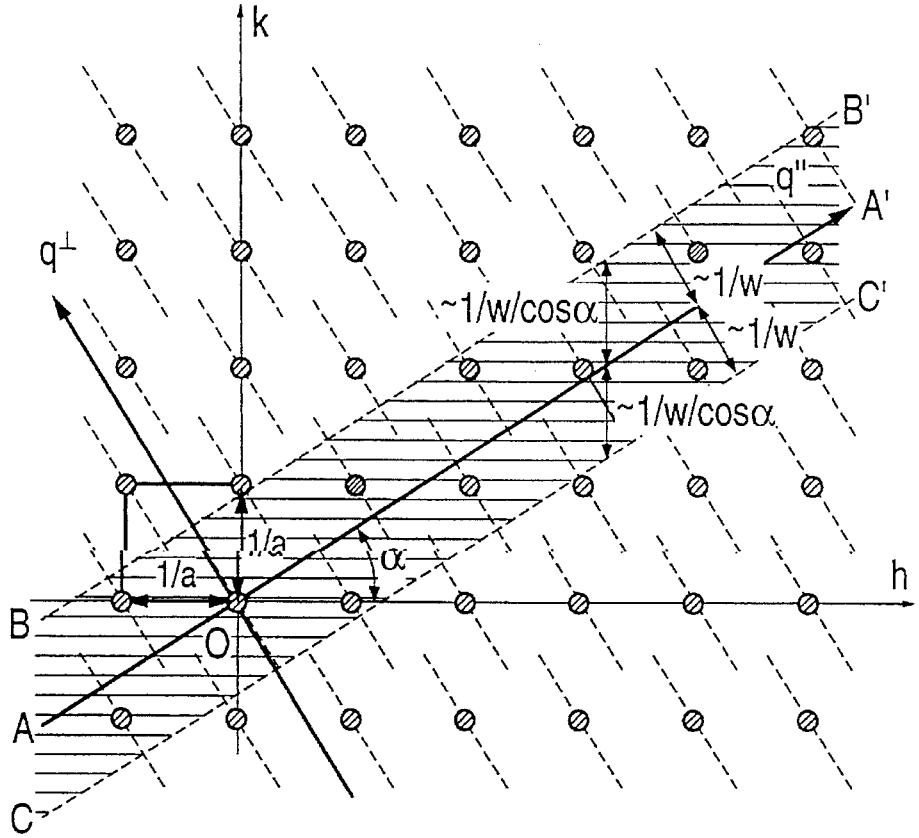
FIG. 3 is a diagram illustrating a Fourier transform of the structure given in FIG. 1, wherein circles reveal the Fourier transform of the 2D square lattice.

FIG. 3 is a diagram illustrating a Fourier transform of the structure given in FIG. 1, wherein circles reveal the Fourier transform of the two-dimensional regular lattice. Restriction of the lattice points within the window AA'B'B in FIG. 1 causes a spike through the peak positions indirected by small circles. The Fourier transform of the projection is given as a cross-section of the spikes by the inclined q" axis.

The function S(q) has delta functions at shaded circles in FIG. 3 which reveal the reciprocal lattice, that is, $$S(q) = N \sum_{i=-\infty}^{\infty} \delta(q - q_i), \tag{16}$$

where $q_i$ is the lattice points and the summation is taken all over the reciprocal lattice. V(q) is depicted by a spike (or streak) running normal to the q" axis irrationally inclined against the h axis. V(q) is here quantitatively calculated as follows: From the definition (13), the Fourier transformation of V(R) is carried out as $$\begin{aligned} V(q) &= \int_{-\infty}^{\infty} V(R) \exp(-2\pi i q \cdot R) dR \\ &= \int_0^w \int_0^L \exp\{-2\pi i (q''R'' + q^{\perp}R^{\perp})\} dR'' dR^{\perp} \\ &= \frac{\sin(\pi L q'')}{\pi q''} \frac{\sin(\pi w q^{\perp})}{\pi q^{\perp}} \exp(\phi), \end{aligned} \tag{17}$$

where exp(ϕ) is a phase factor being meaningless at present. (h,k) and (q",$q^{\perp}$) are the conjugate coordinates of (x,y) and (R",$R^{\perp}$) respectively. Using eqs (3), (4) and (5a and 5b), eq. (17) may be rewritten as $$V(q'',q^{\perp}) = \frac{\sin(\pi L q'')}{\pi q''} \quad \frac{\sin(1.3764\ldots\pi a q^{\perp})}{\pi q^{\perp}} \tag{18}$$

Intensity is represented by a square of eq. (17) or (18), that is, $$V^2(q'',q^{\perp}) = \frac{\sin^2(\pi L q'')}{(\pi q'')^2} \quad \frac{\sin^2(1.3764\ldots\pi a q^{\perp})}{(\pi q^{\perp})^2} \tag{19}$$

The first factor on the right hand side of eq. (19) determines the thickness of the spikes depending on the limited length of the window, L, along the R" axis. The second factor in eq. (19) is evaluated as shown in FIG. 4.

Figure 4:
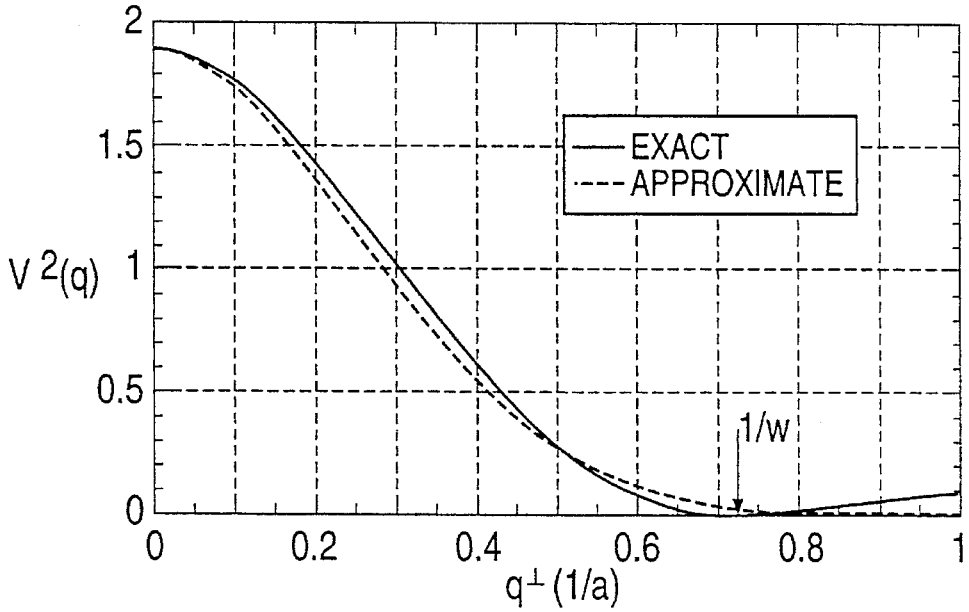
FIG. 4 illustrates Type 1: intensity profile of the spike along the $q^{\perp}$ direction.

FIG. 4 illustrates Type 1: intensity profile of the spike along the $q^{\perp}$ direction. The curve behaves sinusoidally. Damping of the profile along the $q^{\perp}$ direction is very fast and is approximated by a Gaussian function that is drawn in a dotted line. The profile along the spike is depicted by a curve decreasing to zero at $|q^{\perp}|=1/w\approx 0.73/a$ in the present model and therefore the full length of the spikes can be deduced to be $2/w\approx 1.45/a$. This can be approximated by $1.8934\exp\{-(|aq^{\perp}|/0.255)^2/2\}$. Convolution of this function with S(q) [see eq. (15)] means that spikes can be drawn through the lattice points in FIG. 3. Thus, the 2D lattice points included within the region shaded in the figure become meaningful. In Table 2, the positions of the lattice points are listed which contained in the window represented both in (h,k) and (q",$q^{\perp}$) systems. The intensity distributed on the q" axis is determined by the second factor on the right hand side of eq. (19) being a function of $|q^{\perp}|$.

Figure 5:
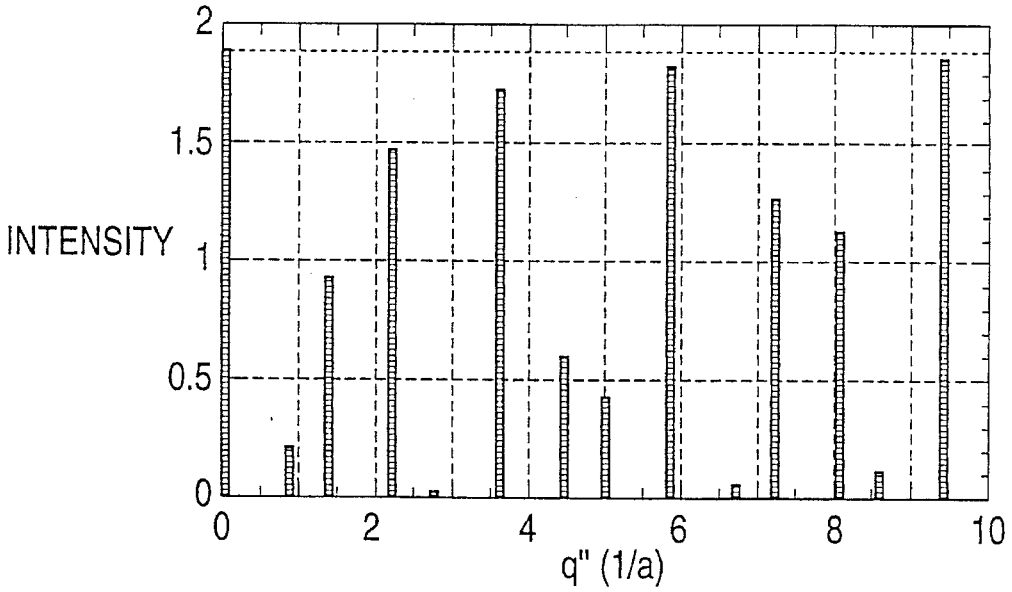
FIG. 5 illustrates a distribution of intensity along the q" axis, that is, a distribution of intensity peaks from the quasi-periodic array.

FIG. 5 shows the intensity distribution along the q" axis, that is the intensity distribution from the quasi-periodic arrangement.

Table 2 shows an intensity distribution on the q" axis in the case of a primitive square lattice with a window (of w in width) spanned by a single cell in 2D real space lattice. The coordinates are represented in unit of 1/a. The inclination, tanα, is taken to be 1/τ. Column "Case of 2w" indicates the intensity peaks appearing in case of the half band width [$|q^{\perp}(i)|<0.36327\ldots(1/a)$].

TABLE 2

| i | h(i) (1/a) | k(i) (1/a) | q"(i) (1/a) | $q^{\perp}(i)$ (1/a) | Intensity | Case of 2w |
|---|---|---|---|---|---|---|
| 1 | 0 | 0 | 0.0000 | 0.0000 | 1.8934 | A |
| 2 | 1 | 0 | 0.8507 | −0.5257 | 0.2135 | |
| 3 | 1 | 1 | 1.3764 | 0.3249 | 0.9336 | A |
| 4 | 2 | 1 | 2.2270 | −0.2008 | 1.4637 | A |
| 5 | 2 | 2 | 2.7528 | 0.6498 | 0.0254 | |
| 6 | 3 | 1 | 3.0777 | −0.7265 | 0.0000 | |
| 7 | 3 | 2 | 3.6034 | 0.1241 | 1.7194 | A |
| 8 | 4 | 2 | 4.4541 | −0.4016 | 0.6110 | |
| 9 | 4 | 3 | 4.9798 | 0.4490 | 0.4365 | |
| 10 | 5 | 3 | 5.8304 | −0.0767 | 1.8260 | A |
| 11 | 6 | 3 | 6.6811 | −0.6024 | 0.0730 | |
| 12 | 6 | 4 | 7.2068 | 0.2482 | 1.2700 | A |
| 13 | 7 | 4 | 8.0575 | −0.2775 | 1.1429 | A |
| 14 | 7 | 5 | 8.5832 | 0.5731 | 0.1169 | |
| 15 | 8 | 5 | 9.4339 | 0.0474 | 1.8681 | A |
| 16 | 9 | 5 | 10.2845 | −0.4783 | 0.3420 | |
| 17 | 9 | 6 | 10.8102 | 0.3723 | 0.7298 | |
| 18 | 10 | 6 | 11.6609 | −0.1534 | 1.6324 | A |
| 19 | 10 | 7 | 12.1866 | 0.6972 | 0.0033 | |
| 20 | 11 | 6 | 12.5115 | −0.6791 | 0.0091 | |

There is another factor of intensity modulation in actual case. That is, the size of the scattering elements results in a monotonous decrease on the intensity with increasing q". This effect is ignored in FIG. 5, moreover, in Table 2. Provided the scattering centers are arranged in a regular way with the same density, the intensity peaks should appear with the same magnitude of 1.8934 . . . (being indicated by a dotted level-line in FIG. 5) and the same inter-peak distance of 1/w=0.7265 . . . (1/a).

The shaded band in FIG. 3 includes a few pairs of the reciprocal lattice points related by factor 2 in coordinate, for example, $(h_i,k_i)=(1,1)(1/a)$ and (2,2)(1/a), (2,1)(1/a) and (4,2)(1/a). This kind of pairing corresponds to a generation of second harmonics in undulator radiation. This will make the undulators useless to some extent. To recover this contradiction, the band width in FIG. 3 may be narrowed or the window width in real space (in FIG. 1) may be widened. The column of "Case of 2w" in Table 2 indicates the peaks appearing after having the band width in reciprocal space. The problem will be discussed again in creating a quasi-periodic array of magnets on the undulators.

Next, a constructure of a quasi-periodic array of magnets on an undulator will be described hereinbelow.

A method has been developed for creating a quasi-periodic array of alternate positive and negative centers corresponding to the alternate magnetic field on the basis of the principle mentioned above.

First, straightforward application to two kinds (±) of centers (Type 1) will be described.

Figure 6:
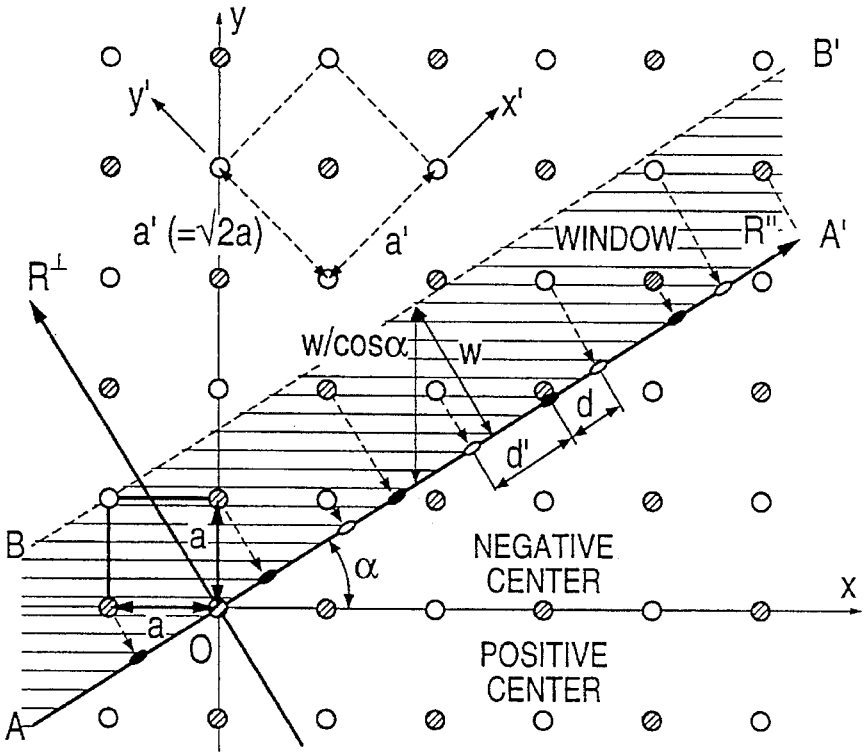
FIG. 6 illustrates Type 1: a creation of one-dimensional quasi-periodic lattice with two kinds of centers from a 2D regular lattice.

FIG. 6 illustrates Type 1: a creation of one-dimensional quasi-periodic lattice with two kinds of centers from a regular lattice.

Expecting an alternate arrangement of positive and negative centers on a line that corresponds to the magnet array on undulator, two kinds of sites with open and full circles are provided in FIG. 6. That is, open circles represent some positive center and full circles negative one with the same magnitude. A new unit cell is defined to include two sites, an open circle and a full circle, with a cell parameter of a', which is rotated 45 degrees against the xy coordinate system as shown in FIG. 6. That is, $$a'=a\sqrt{2}. \tag{20}$$

The two kinds of centers are positioned at the lattice points $(x_i,y_i)$'s satisfying a relation $$\frac{x_i+y_i}{a} = \begin{cases} \text{even integer,} & \text{for positive contribution,} \\ \text{odd integer,} & \text{for negative contribution.} \end{cases} \tag{21}$$

Here, a is the nearest neighbor distance. All the nearest neighbors around an open circle are entirely full circles and vice versa. This is to cause an alternate array of positive and negative magnetic fields along the electron path in the undulator.

Let it be supposed that a window AA'B'B have a width of w given by eq. (4) and be inclined with a slope of 1/τ against the x axis by simply following the previous procedure. This method for creating a quasi-periodic lattice will be referred to as 'Type 1'. The lattice points $(x_i,y_i)$'s included within the window are then projected on the inclined R" axis. All the equations from (3) to (9) may be used in common with the present case.

Referring to FIG. 6, the positive and negative centers are alternately aligned in an aperiodic fashion on the R" axis. This configuration is again illustrated in FIG. 7, and the positions of the 2D lattice points within the window and their projected points are listed in Table 3, indicating a quasi-periodic array of d' and d distances between the points. Further, properties of their contributions are listed in the column of 'Contribution', in which an alternate arrangement of positive and negative contributions can be seen. It is compared to the alternate magnetic field (or electron trajectory) in the undulator.

Figure 7:
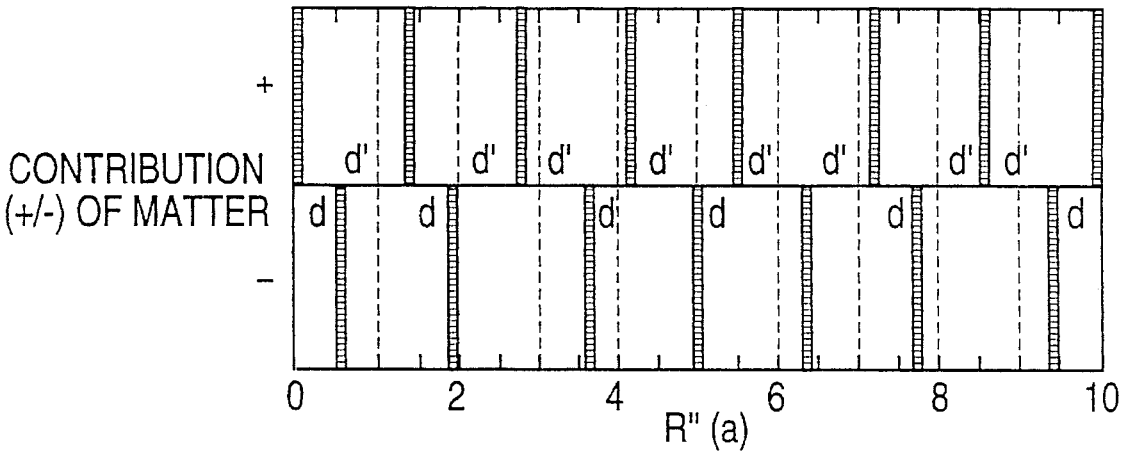
FIG. 7 illustrates Type 1: a quasi-periodic arrangement of ± centers.

FIG. 7 illustrates Type 1: a quasi-periodic arrangement of ± centers. Bars represent positive and negative contributions of the centers. The symbols "d'" and "d" indicate the distances between the quasi-lattice points, and d'=τd. Table 3 is a list of the coordinates used in creating a quasi-periodic lattice for Type 1 (tanα=1/τ and a window spanned by an axa cell).

TABLE 3

| i | x(i) (a) | y(i) (a) | R"(i) (a) | Contribution | Distance to next (a) |
|---|---|---|---|---|---|
| 1 | 0 | 0 | 0.0000 | 1 | 0.5257 |
| 2 | 0 | 1 | 0.5257 | −1 | 0.8507 |
| 3 | 1 | 1 | 1.3764 | 1 | 0.5257 |
| 4 | 1 | 2 | 1.9021 | −1 | 0.8507 |
| 5 | 2 | 2 | 2.7528 | 1 | 0.8507 |
| 6 | 3 | 2 | 3.6034 | −1 | 0.5257 |
| 7 | 3 | 3 | 4.1291 | 1 | 0.8507 |
| 8 | 4 | 3 | 4.9798 | −1 | 0.5257 |
| 9 | 4 | 4 | 5.5055 | 1 | 0.8507 |
| 10 | 5 | 4 | 6.3562 | −1 | 0.8507 |
| 11 | 6 | 4 | 7.2068 | 1 | 0.5257 |
| 12 | 6 | 5 | 7.7326 | −1 | 0.8507 |
| 13 | 7 | 5 | 8.5832 | 1 | 0.8507 |
| 14 | 8 | 5 | 9.4339 | −1 | 0.5257 |
| 15 | 8 | 6 | 9.9596 | 1 | 0.8507 |
| 16 | 9 | 6 | 10.8102 | −1 | 0.5257 |
| 17 | 9 | 7 | 11.3360 | 1 | 0.8507 |
| 18 | 10 | 7 | 12.1866 | −1 | 0.8507 |
| 19 | 11 | 7 | 13.0373 | 1 | 0.5257 |
| 20 | 11 | 8 | 13.5630 | −1 | 0.8507 |

Figure 8:
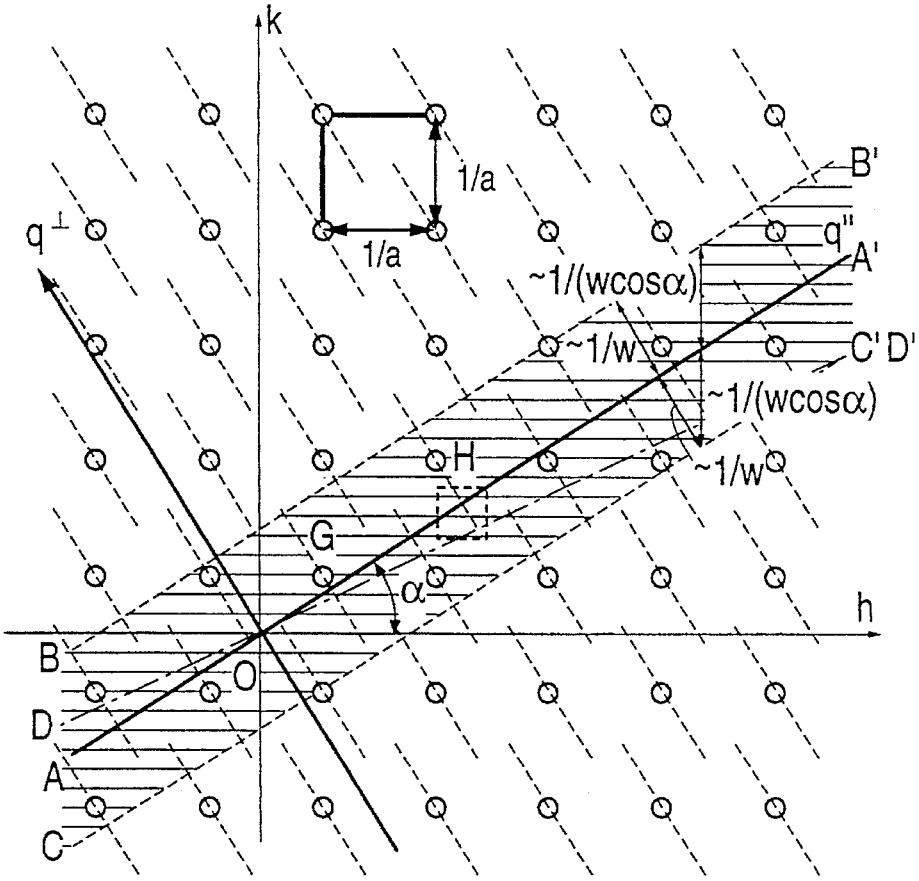
FIG. 8 illustrates Type 1: a Fourier transform of the structure given in FIG. 6.

All the equations from (15) to (19) can be applied to this model in the same form. S(q) here is the structure factor for the arrangement of centers defined in FIG. 6 and has amplitude peaks only on the reciprocal lattice points $(h_i,k_i)$'s of $$(h_i,k_i) = (n_1,n_2)\left(\frac{1}{a}\right),\ n_1,n_2 \text{ being half-integers,} \tag{22}$$

which are plotted by small circles in FIG. 8.

FIG. 8 illustrates Type 1: a Fourier Transform of the structure given in FIG. 6. Circles reveal the Fourier transform of the two-dimensional regular lattice with positive and negative contributions. The Fourier transform of the projection is given as a cross-section of the spikes by an inclined q" axis.

Figure 9:
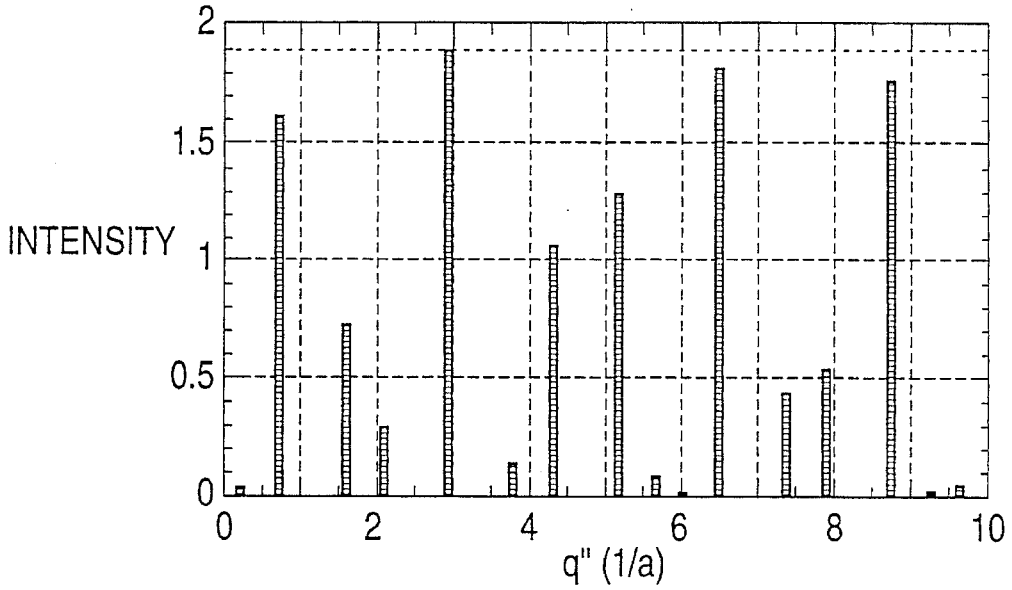
FIG. 9 illustrates Type 1: an intensity distribution from the quasi-periodic array.

The intensity diffracted from the quasi-periodic structure created on the inclined R" axis in real space is realized on the q" axis in the figure. Resultant intensity distribution is shown in FIG. 9 and numerical results are listed in Table 4, where the two kinds of intensity modulations are omitted. One is on the thickness of the spikes depending on the size L along the R" direction, and the other appears on the amplitude of the spikes as a monotonous decrease along the q" direction. The latter effect is entirely ignored in this specification.

FIG. 9 illustrates Type 1: an intensity distribution from the quasi-periodic array. The peak positions are dispersed irrationally on the q" axis.

Table 4 is an intensity distribution on the q" axis in the case of a composite square lattice with an a'xa' unit cell. The inclination is 1/τ and the window, w, is spanned by a square of axa. Column "Case of 2w" indicates the intensity peaks appearing in the case of the half hand width $|q^{\perp}(i)|$]<0.36327 . . . (1/a)] in reciprocal space for Type 2.

TABLE 4

| i | h(i) (1/a) | q"(i) (1/a) | $q^{\perp}(i)$ (1/a) | (1/a) | Intensity | Case of 2w |
|---|---|---|---|---|---|---|
| 1 | 0.5 | −0.5 | 0.1625 | −0.6882 | 0.0058 | |
| 2 | 0.5 | 0.5 | 0.6882 | 0.1625 | 1.6026 | A |
| 3 | 1.5 | 0.5 | 1.5388 | −0.3633 | 0.7678 | |
| 4 | 1.5 | 1.5 | 2.0646 | 0.4874 | 0.3151 | |
| 5 | 2.5 | 1.5 | 2.9152 | −0.0384 | 1.8771 | A |
| 6 | 3.5 | 1.5 | 3.7659 | −0.5641 | 0.1329 | |
| 7 | 3.5 | 2.5 | 4.2916 | 0.2866 | 1.1030 | A |
| 8 | 4.5 | 2.5 | 5.1423 | −0.2392 | 1.3084 | A |
| 9 | 4.5 | 3.5 | 5.6680 | 0.6115 | 0.0617 | |
| 10 | 5.5 | 3.5 | 6.5186 | 0.0858 | 1.8092 | A |
| 11 | 6.5 | 3.5 | 7.3693 | −0.4400 | 0.4679 | |
| 12 | 6.5 | 4.5 | 7.8950 | 0.4107 | 0.5759 | |
| 13 | 7.5 | 4.5 | 8.7457 | −0.1151 | 1.7432 | A |
| 14 | 8.5 | 4.5 | 9.5963 | −0.6408 | 0.0324 | |
| 15 | 8.5 | 5.5 | 10.1221 | 0.2099 | 1.4283 | A |
| 16 | 9.5 | 5.5 | 10.9727 | −0.3159 | 0.9735 | A |
| 17 | 9.5 | 6.5 | 11.4984 | 0.5348 | 0.1926 | |
| 18 | 10.5 | 6.5 | 12.3491 | 0.0091 | 1.8935 | A |
| 19 | 11.5 | 6.5 | 13.1997 | −0.5167 | 0.2356 | |
| 20 | 11.5 | 7.5 | 13.7255 | 0.3340 | 0.8939 | A |

Provided the (±) scattering centers are alternately arranged in a regular manner with the same density, the intensity peaks should happen with the same magnitude of 1.8934 . . . (being indicated by a dotted level-line in FIG. 9) and the same inter-peak distance of 2/w=1,453 . . . (1/a).

Here, an appearance of a pair of intensity peaks on the q" axis should be noted. That is, it can be seen in FIG. 9 or Table 4 that there is a first strong peak at q"=0.688 . . . (1/a) (due to the reciprocal lattice points G in FIG. 8) and a relatively strong peak at q"=2.065 . . . (1/a) (due to H) which is three times the q" value of the first peak. This kind of harmonicity has been briefly noted in the elementary model discussed hereinbefore. This contamination of the third harmonic corresponds to an intersection of the streak from the (1.5, 1.5)(1/a) point and the q" axis, which is marked by a small dotted square in FIG. 8 and is considered to be avoided by 1) widening the window, 2) changing the inclination of the q" axis, or 3) choosing different kinds of 2D lattice.

The second and third methods will be described hereinbelow. Before going there, they are here shortly explained.

It has found that the length of the spike is inversely proportional to the width of window. If a window spanned by a square (2a×2a) are employed, instead of the axa cell, the reciprocal lattice points must have spikes with half length of the present one and small intensity peaks (including the third harmonic) are to disappear. The rational contamination can be also avoided by choosing another irrational slope for the inclined q" axis in FIG. 8. A line DD' shows an example of another possible slope that generates no peak at the third harmonic position.

Next, method of widening the window in 2D real space (Type 2) will be described hereinbelow.

Figure 10:
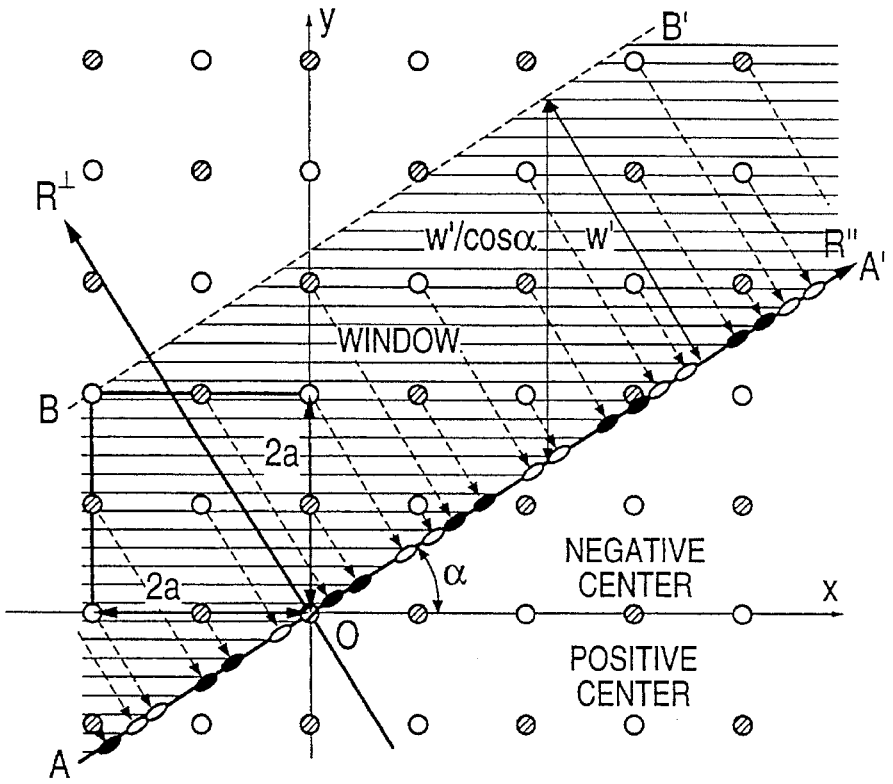
FIG. 10 illustrates Type 2, wherein the width window, w', is twice that of Type 1.

FIG. 10 is a diagram illustrating Type 2 wherein the width of window, w', is twice that of Type 1. Lattice points in the window AA'B'B are projected onto AA'. The slope of the q" axis, tan α, is taken to the same 1/τ as in Type 1. A quasi-periodic lattice is created on the AA'. The cell drawn with a corner at the origin, O, includes 4 lattice sites.

Figure 11:
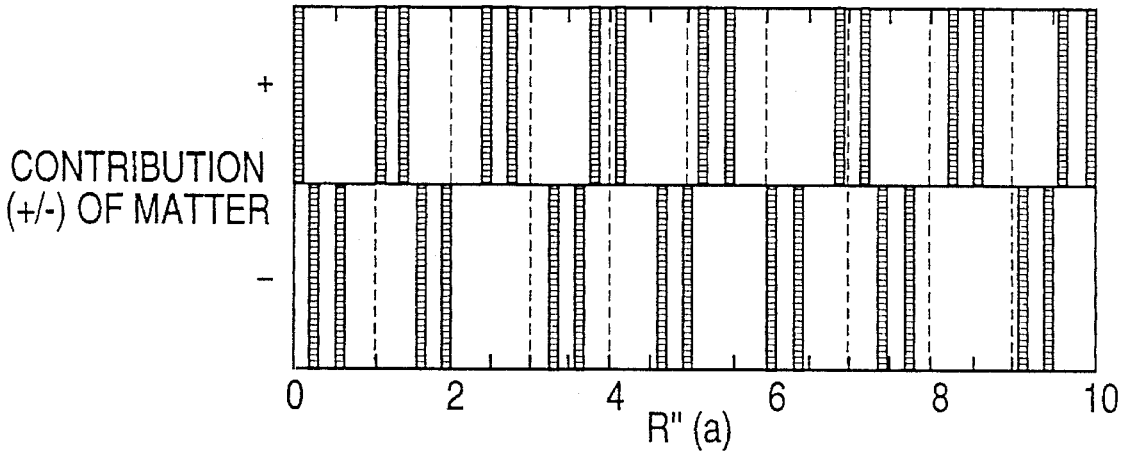
FIG. 11 illustrates Type 2: a quasi-periodic arrangement of ± centers.

FIG. 11 illustrates Type 2: a quasi-periodic arrangement of ± centers. A pairing of positive or negative centers is characteristic. There are three kinds of inter-matter distance. The projected pattern on the R" axis, which is schematically presented in FIG. 11, becomes a little complicated in comparison with the previous case. Numerical values of the coordinates are listed in Table 5. Table 5 is a list of the coordinates in creating a quasi-periodic lattice for Type 2 ($\tan\alpha=1/\tau$ and a window spanned by 2a×2a cell).

TABLE 5

| i | x(i) (a) | y(i) (a) | R"(i) (a) | Contribution | Distance to next (a) |
|---|---|---|---|---|---|
| 1 | −2 | −1 | −2.2270 | −1 | 0.5257 |
| 2 | −2 | 0 | −1.7013 | 1 | 0.5257 |
| 3 | −2 | 1 | −1.1756 | −1 | 0.3249 |
| 4 | −1 | 0 | −0.8507 | −1 | 0.5257 |
| 5 | −1 | 1 | −0.3249 | 1 | 0.3249 |
| 6 | 0 | 0 | 0.0000 | 1 | 0.2008 |
| 7 | −1 | 2 | 0.2008 | −1 | 0.3249 |
| 8 | 0 | 1 | 0.5257 | −1 | 0.5257 |
| 9 | 0 | 2 | 1.0515 | 1 | 0.3249 |
| 10 | 1 | 1 | 1.3764 | 1 | 0.2008 |
| 11 | 0 | 3 | 1.5772 | −1 | 0.3249 |
| 12 | 1 | 2 | 1.9021 | −1 | 0.5257 |
| 13 | 1 | 3 | 2.4278 | 1 | 0.3249 |
| 14 | 2 | 2 | 2.7528 | 1 | 0.5257 |
| 15 | 2 | 3 | 3.2785 | −1 | 0.3249 |
| 16 | 3 | 2 | 3.6034 | −1 | 0.2008 |
| 17 | 2 | 4 | 3.8042 | 1 | 0.3249 |
| 18 | 3 | 3 | 4.1291 | 1 | 0.5257 |
| 19 | 3 | 4 | 4.6549 | −1 | 0.3249 |
| 20 | 4 | 3 | 4.9798 | −1 | 0.2008 |

It can be seen to be an interesting feature that pairs of the same (+ or −) contributions are alternately aligned.

Figure 12:
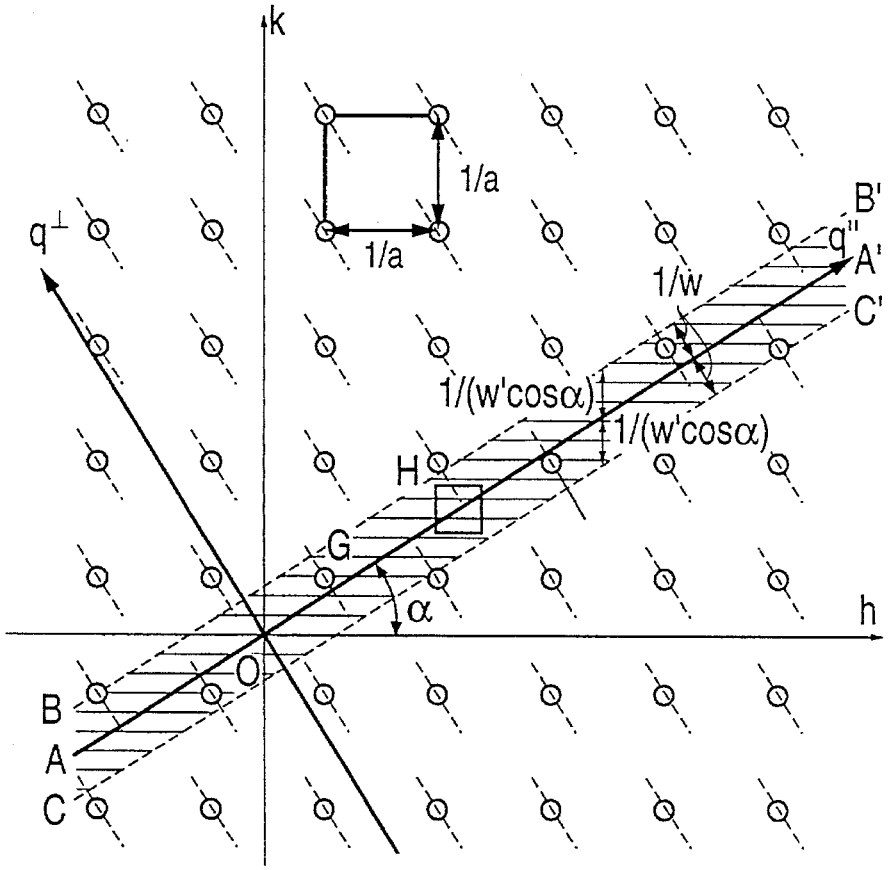
FIG. 12 illustrates Type 2: a Fourier transform of the structure of Type 2 given in FIG. 10.

FIG. 12 illustrates Type 2: a Fourier transform of the structure given in FIG. 10. Circles revealing the Fourier transform of the two-dimensional regular lattice are the same as in Type 1. Restriction of the lattice points within the wider window AA'B'B of w' in FIG. 10 causes shorter spikes. FIG. 12 reveals the reciprocal lattice, on which the length of the spikes is half in comparison with the previous model. That is, only the lattice points within the narrower region BB'C'C selectively contribute to the intensity distribution on the q" axis, which are marked by "A" in the column "Case of 2w" in Table 4. This shortening of the spikes suppresses the third harmonic that appeared in the previous case.

Figure 13:
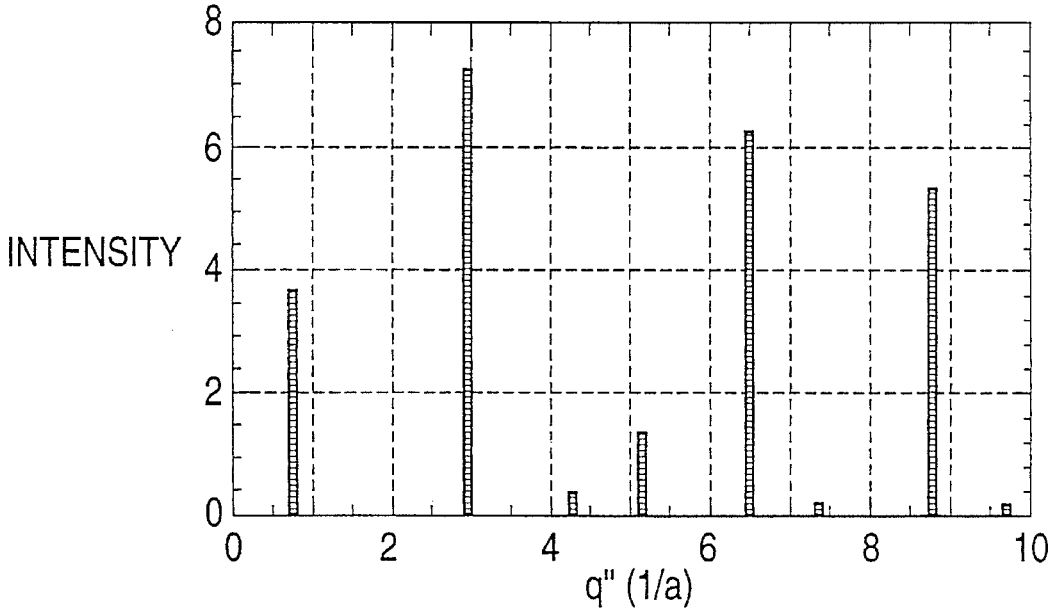
FIG. 13 illustrates Type 2: an intensity distribution diffracted from the quasi-periodic array of FIG. 11.

FIG. 13 illustrates Type 2: an intensity distribution diffracted from the quasi-periodic array of FIG. 11, in which distribution peaks are irrationally separated. The peak positions are dispersed irrationally on the q" axis. The density of peaks is less than that in Type 1.

Next, a method of changing the inclination angle of the q" axis (Type 3) will be described hereinbelow.

Figure 14:
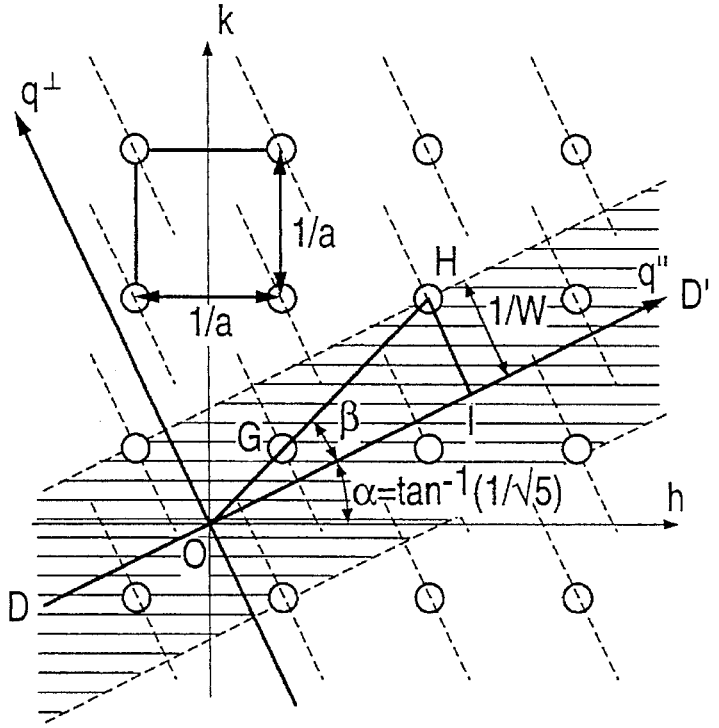
FIG. 14 illustrates Type 3: a geometry to determine an inclination of the q" axis with which a contamination of the third harmonic is suppressed.

If the inclined line, i.e., the q" axis does not intersect the spike elongated from the reciprocal lattice point H in FIG. 14, the third harmonic never appears. FIG. 14 illustrates Type 3: a geometry to determine an inclination of the q" axis with which a contamination of the third harmonic is suppressed. The circles, G and H, are related in a rational fashion. The point is to avoid a contact of the spike from H and the q" axis. The dotted circle, I, is the extremity of the spike from H. The window in the real space lattice is supposed to include a square of axa. In this way, the cross-section DD' shown in FIG. 14 does not include any rational contaminations. The extremely of the spike touches the q" axis, if the point H is distant from the axis by $q_H^{\perp}$ satisfying eq. (19)=0, i.e., $$\frac{\sin(\pi w q_H^{\perp})}{\pi q_H^{\perp}} = 0. \tag{23}$$

Then, we have $$q_H^{\perp} = \frac{1}{w} = \frac{1}{(\sin\alpha + \cos\alpha)a}. \tag{24}$$

According to the geometry in FIG. 14, the inclination angle, α, may be evaluated as $$IH = \left(\frac{3\sqrt{2}}{2}\right)\sin\beta = \left(\frac{3\sqrt{2}}{2}\right)\sin\left(\frac{\pi}{4} - \alpha\right) = \frac{1}{\sin\alpha + \cos\alpha}.$$

This is developed into $$\cos^2\alpha - \sin^2\alpha = \frac{2}{3},$$

then $$\alpha = \tan^{-1}\left(\frac{1}{\sqrt{5}}\right), \tag{25a}$$

or $$\alpha = 24.0948\ldots \text{ (degrees)}. \tag{25b}$$

Figure 15:
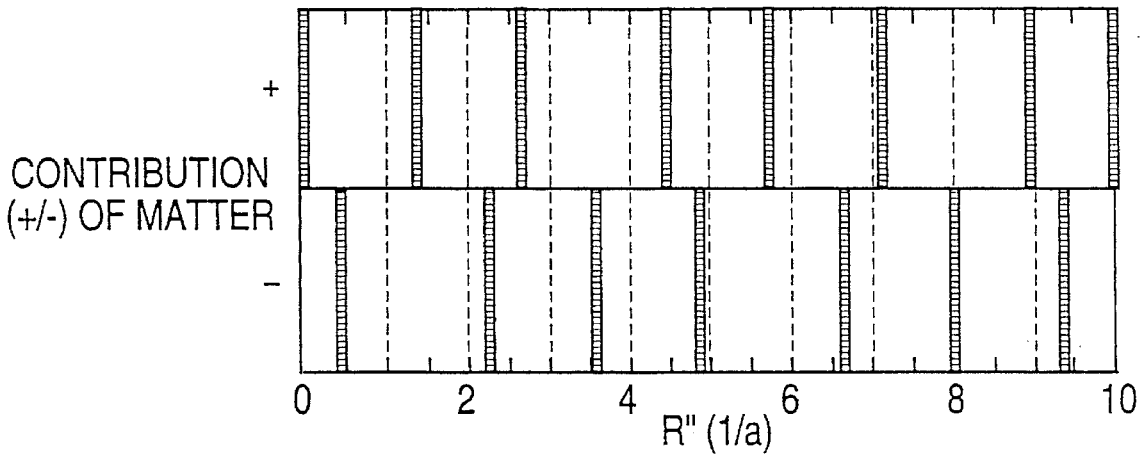
FIG. 15 illustrates Type 3: an arrangement of centers.
Figure 16:
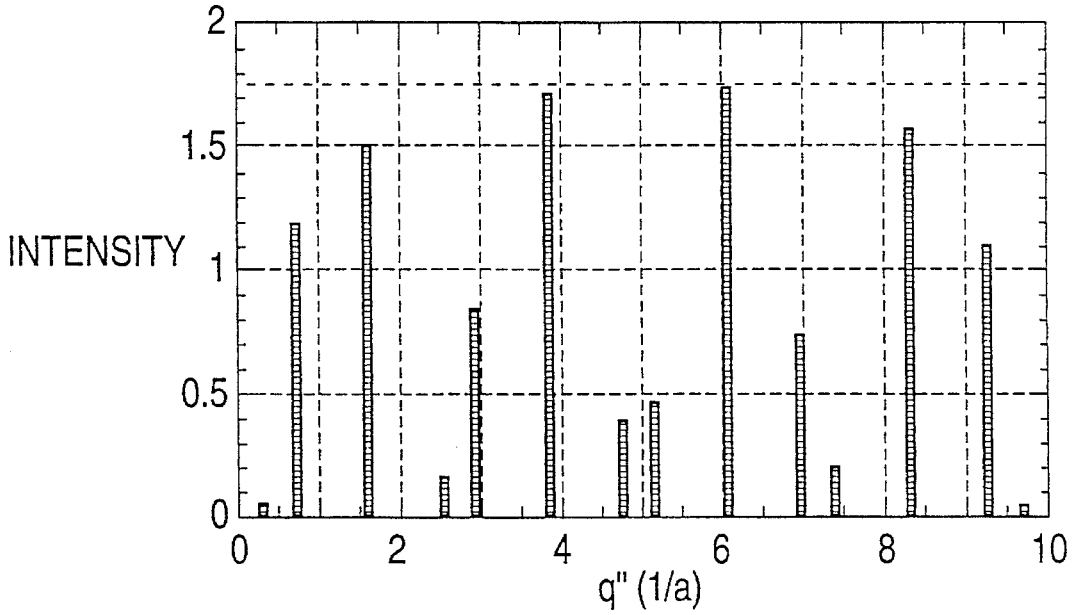
FIG. 16 illustrates an intensity distribution given by the geometry in FIG. 15.

This inclination generates an irrational number $\sqrt{5}$ and never creates a periodic contamination both on the R" and q" axes (see FIGS. 15 and 16).

Figure 17:
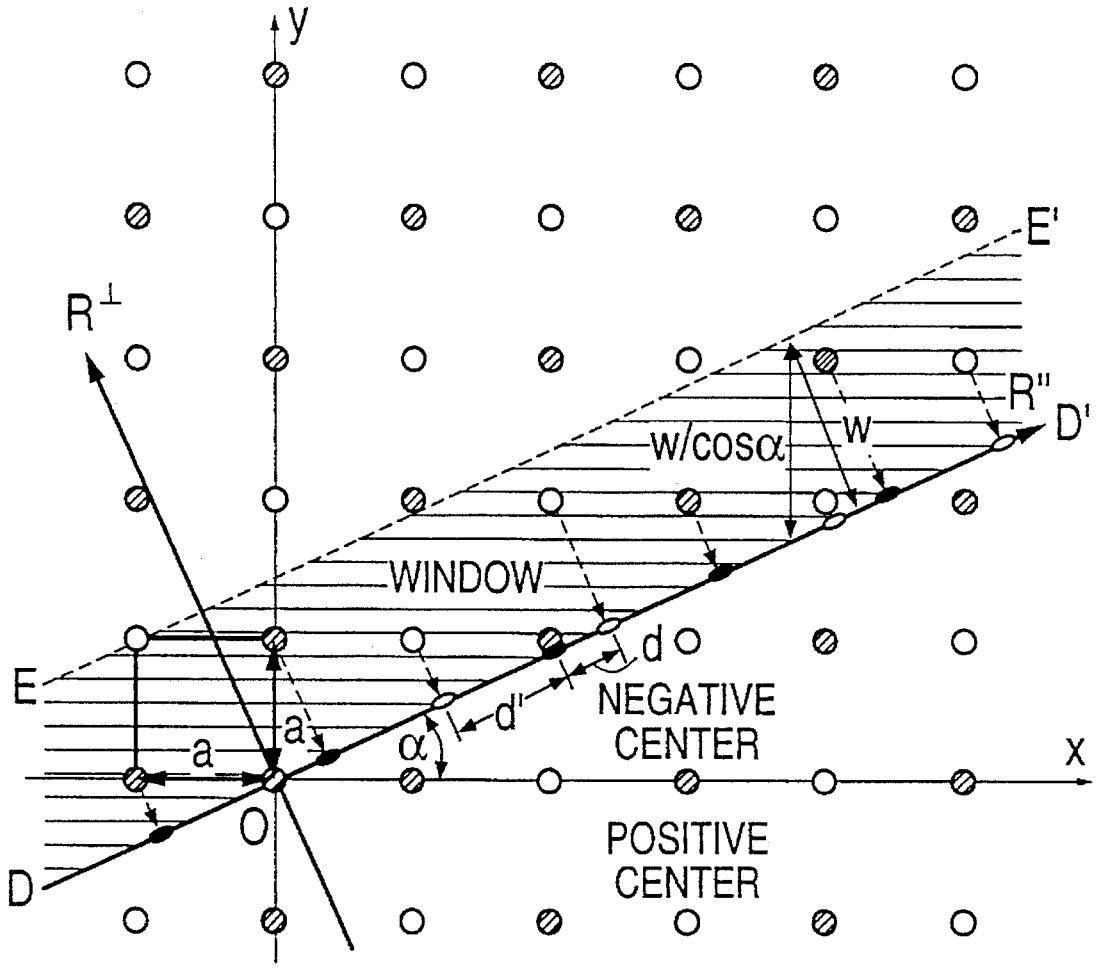
FIG. 17 illustrates Type 3: a real space construction.

FIG. 15 illustrates Type 3: an arrangement of centers. The distances, d' and d, are different from those in Type 1, whose ratio is 1.38 . . . times larger. FIG. 16 illustrates Type 3: an intensity distribution given by the geometry in FIG. 15. The peak positions are dispersed irrationally on the q" axis. The creation of the R (real)-space distribution is illustrated in FIG. 17, which shows Type 3: Real space construction. The slope of the line AA', $\tan\alpha$ is $1/\sqrt{5}$. The distances, d' and d, are different from those of Type 1.

Table 6 is a list of the coordinates used in creating a quasi-periodic lattice for Type 3 ($\tan\alpha=1/\sqrt{5}$ and a window spanned by an axa cell). Table 6 lists the coordinates used in the creation procedure, which shows two kinds of nearest neighboring distances of 0.9129 . . . and 0.4082 . . . having a ratio of $\sqrt{5}$. This ratio is 1.38 . . . times larger than τ. Table 7 is for q-space in this case. Table 7 shows an intensity distribution on the q" axis for Type 3 (window spanned by an axa cell). Coordinates used for creating the hk space lattice are also listed. If the (±) scattering centers are alternately arranged in a regular manner with the same density, the intensity peaks should take place with the magnitude of 1.7454 . . . (being indicated by a dotted line in FIG. 16) and the inter-peak distance of 2/w=1.5139 . . . (1/a).

TABLE 6

| i | x(i) (a) | y(i) (a) | R"(i) (a) | Contribution | Distance to next (a) |
|---|---|---|---|---|---|
| 1 | 0 | 0 | 0.0000 | 1 | 0.4082 |
| 2 | 0 | 1 | 0.4082 | −1 | 0.9129 |
| 3 | 1 | 1 | 1.3211 | 1 | 0.9129 |
| 4 | 2 | 1 | 2.2340 | −1 | 0.4082 |
| 5 | 2 | 2 | 2.6422 | 1 | 0.9129 |
| 6 | 3 | 2 | 3.5551 | −1 | 0.9129 |
| 7 | 4 | 2 | 4.4680 | 1 | 0.4082 |
| 8 | 4 | 3 | 4.8762 | −1 | 0.9129 |
| 9 | 5 | 3 | 5.7891 | 1 | 0.9129 |
| 10 | 6 | 3 | 6.7020 | −1 | 0.4082 |
| 11 | 6 | 4 | 7.1102 | 1 | 0.9129 |
| 12 | 7 | 4 | 8.0231 | −1 | 0.9129 |
| 13 | 8 | 4 | 8.9360 | 1 | 0.4082 |
| 14 | 8 | 5 | 9.3442 | −1 | 0.9129 |
| 15 | 9 | 5 | 10.2571 | 1 | 0.9129 |
| 16 | 10 | 5 | 11.1700 | −1 | 0.9129 |

TABLE 6-continued

| i | x(i) (a) | y(i) (a) | R"(i) (a) | Contribution | Distance to next (a) |
|---|---|---|---|---|---|
| 17 | 11 | 5 | 12.0828 | 1 | 0.4082 |
| 18 | 11 | 6 | 12.4911 | −1 | 0.9129 |
| 19 | 12 | 6 | 13.4039 | 1 | 0.9129 |
| 20 | 13 | 6 | 14.3168 | −1 | 0.4082 |

TABLE 7

| i | h(i) (1/a) | k(i) (1/a) | q"(i) (1/a) | $q^{\perp}$(i) (1/a) | Intensity |
|---|---|---|---|---|---|
| 1 | 0.5 | −0.5 | 0.2532 | −0.6606 | 0.035 |
| 2 | 0.5 | 0.5 | 0.6606 | 0.2523 | 1.194 |
| 3 | 1.5 | 0.5 | 1.5734 | −0.1559 | 1.515 |
| 4 | 2.5 | 0.5 | 2.4863 | −0.5642 | 0.164 |
| 5 | 2.5 | 1.5 | 2.8945 | 0.3487 | 0.821 |
| 6 | 3.5 | 1.5 | 3.8074 | −0.0596 | 1.710 |
| 7 | 4.5 | 1.5 | 4.7203 | −0.4678 | 0.402 |
| 8 | 4.5 | 2.5 | 5.1285 | 0.4451 | 0.473 |
| 9 | 5.5 | 2.5 | 6.0414 | 0.0368 | 1.732 |
| 10 | 6.5 | 2.5 | 6.9543 | −0.3714 | 0.734 |
| 11 | 6.5 | 3.5 | 7.3625 | 0.5414 | 0.210 |
| 12 | 7.5 | 3.5 | 8.2754 | 0.1332 | 1.575 |
| 13 | 8.5 | 3.5 | 9.1883 | −0.2751 | 1.107 |
| 14 | 8.5 | 4.5 | 9.5965 | 0.6378 | 0.056 |
| 15 | 9.5 | 3.5 | 10.1011 | −0.6833 | 0.020 |
| 16 | 9.5 | 4.5 | 10.5094 | 0.2296 | 1.277 |
| 17 | 10.5 | 4.5 | 11.4223 | −0.1787 | 1.448 |
| 18 | 10.5 | 5.5 | 11.8305 | 0.7342 | 0.002 |
| 19 | 11.5 | 4.6 | 12.3596 | −0.5322 | 0.231 |
| 20 | 11.5 | 5.5 | 12.7434 | 0.3259 | 0.909 |

Next, a real array of magnetic poles of the undulator will be described hereinbelow.

As an example, Type 3 of the pole-array given in FIG. 15 is chosen. That is, let the bars in the positive side correspond to the positive poles and bars in the negative side to negative poles. FIG. 18B illustrates a quasi-periodic array of magnets, that is, Type 3: a model structure of a magnetic segments on the undulator. This is created by analogy with the structure given in FIG. 15 or 17. The distance d is made by the size of the magnet itself and d' the sum of d and a spacer of $d(\sqrt{5}-1)$. The notes of d' and d put in FIGS. 18A and 18B indicate the distances between the bars, that is, between the centers of the magnetic poles. In the mode shown in FIG. 18B, the same magnets of d in length are employed and a spacer of (d'-d) is inserted between the two magnetic segments of inter-pole distance of d'. The electrons passing through this kind of undulator equally interfere with the fields of positive and negative poles and return to the original orbital path. This model array of magnets will generate a spectrum analogous with the pattern in FIG. 16. Of course, the q" axis must be taken for the energy axis. The width of the maxima (or energy width) depends on the length of the undulator.

Figure 18A:
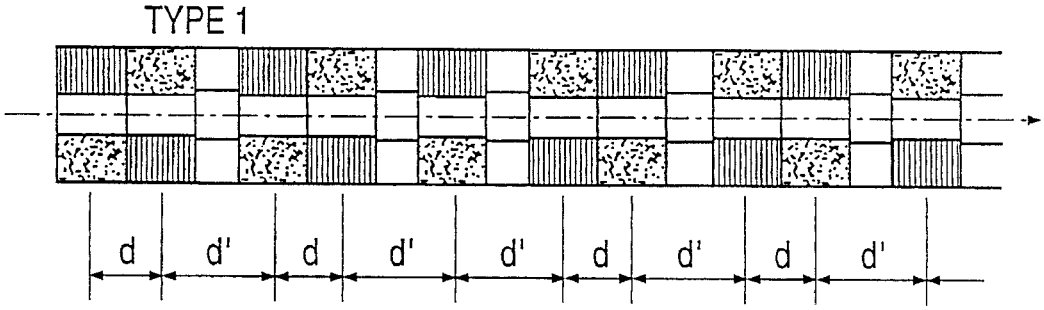
FIG. 18A illustrates Type 1: a model structure of magnetic segments on an undulator.
Figure 18B:
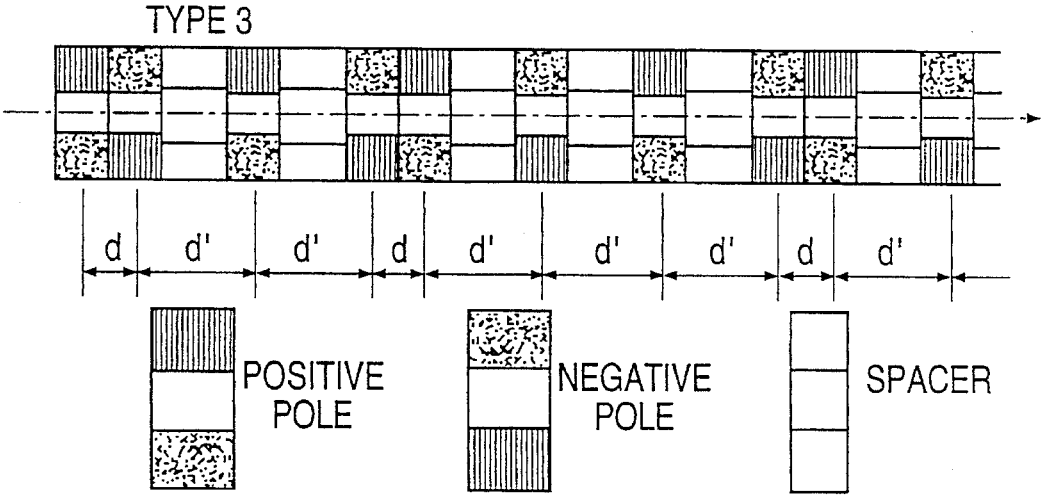
FIG. 18B illustrates Type 3: a model structure of magnetic segments on an undulator.

Type 1 also presented in FIG. 18A for the sake of comparison. FIG. 18A illustrates Type 1: a model structure of magnetic segments on the undulator. This is created by analogy with the structure given in FIG. 6 or 7. Two kinds of inter-magnet distances are necessary. The distance d is made by the size of the magnet itself and d' the sum of d and a spacer of $d/\tau$.

The explanation mentioned above will be here summarized.

The method of suppressing the rational higher harmonics with respect to an undulator is a very different concept compared to prior arts. By analogy with the diffraction theory, the quasi-periodic array of magnets on the undulator is understood to have a possibility of suppressing rational higher harmonics.

The spacers inserted among the magnetic segments mentioned above do not positively contribute to the magnetic field, that is, the power of radiation. To recover this power loss, it is necessary to seek for optimum conditions to create the quasi-periodicity. Any periodic lattice, for example, triangular, hexagonal, etc. can be adopted.

A generalized process for designing an undulator with a quasi-periodic array of magnets is as follows;

1) Define a 2D or higher dimensional lattice with two kinds of scattering centers (±) arranged in an alternate manner.
2) Fourier-transform the higher dimensional lattice structure and get a reciprocal lattice.
3) Draw a line (one-dimensional) irrationally inclined against the lattice axes in the reciprocal lattice and determine the length of the spikes at the reciprocal lattice points so as to avoid a generation of rational harmonics.
4) If 3) is not successful, return to 1).
5) In the real lattice defined in 1), draw a line conjugate to the line defined in the reciprocal lattice in 3) and determine the width of the window by inverting the length of the spikes.
6) Project the lattice points within the window on the line drawn in 5).
7) Check a possibility of realizing the quasi-periodic pole array in the undulator. If impossible, return to 1).

The quasi-periodical magnetic pole array which has been obtained by the above-mentioned process can be generalized as follows.

By assuming $x_n$ as the normalized coordinate of the n-th magnetic poles (n is an integer) and $\tau$ as an optional irrational number, the $x_n$ can be expressed as follows according to the generalized Fibonacci series.

$$x_n = n + \left(\frac{1}{\tau} - 1\right)\left[\frac{1}{\tau+1}\, n + 1\right] \tag{26}$$

wherein [X] signifies Gauss notation which is the function having the maximum integer value under X.

In order to generate only irrational-order-harmonic waves without generating rational-order harmonic waves, the period of a magnetic field or the period of a double integral of the field thereof must satisfy a quasi-period, that is, the series of the peak values of the magnetic field or the series of the peak values of the double integral of the field must satisfy the relation of generalized Fibonacci series. The description has been made in connection with a method to satisfy such a requirement in the case where the thickness of the magnets in the array direction is equal. It is also possible, however, to satisfy the above-mentioned requirement even if the thickness and intensity of each of the magnets of the positive pole and negative pole are not equal but are of suitable size.

An embodiment in which the thickness of magnets is not equal but varied will now be explained.

Figure 19:
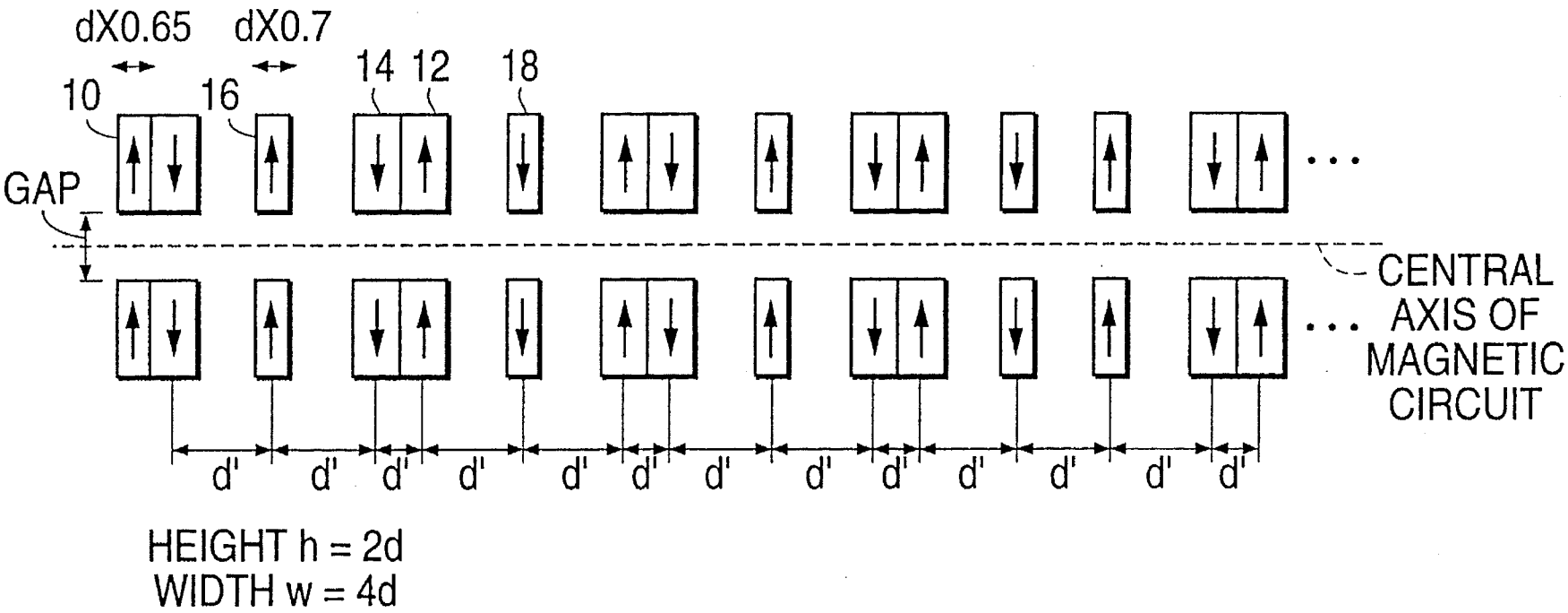
FIG. 19 illustrates a part of an array of magnets in which the thickness of an isolated magnet in the array direction is thinner than that of a paired magnets with different polarities and in contact with each other, in the case of $\tau$ being $\sqrt{5}$.

FIG. 19 illustrates a part of the array of the magnets in the case of $\tau$ being $\sqrt{5}$. This shows an array of the magnetic poles up to 7th period from the side of the electron being incident cut out of the array of the magnetic poles of the quasi-periodic undulator having 50 periods (one period being consisting of a positive pole and a negative pole). In the drawing, the magnet designated by the reference numeral 10 at the left end is added for compensating the electron orbit and has nothing to do with the array of generalized Fibonacci series. When the longer distance between the magnets is taken as d' while the shorter distance is taken as d, then the relation of $d'/d=\tau=\sqrt{5}$ is attained. For example, the thickness of each magnet in a pair of a positive magnet 12 and a negative magnet 14 which are in contact with each other in the direction of array is taken to be d. The thickness of the magnet 16 or 18 which is isolated from each other is 0.7 times that of each magnet in the pair of magnets 12, 14 which are in contact with each other. It is to be noted that the thickness of the magnet 10 is 0.65 times d. The height h of the respective magnets is 2d and the width thereof w is 4d. In actual calculation of spectrum of the radiation from the undulator, the distances between the magnets were taken as d=20.41 mm and d'=45.64 mm by multiplying the normalized coordinate expressed by the eq. (26) with a certain factor since the magnetic field is calculated by use of the size of actual magnets.

Figure 20:
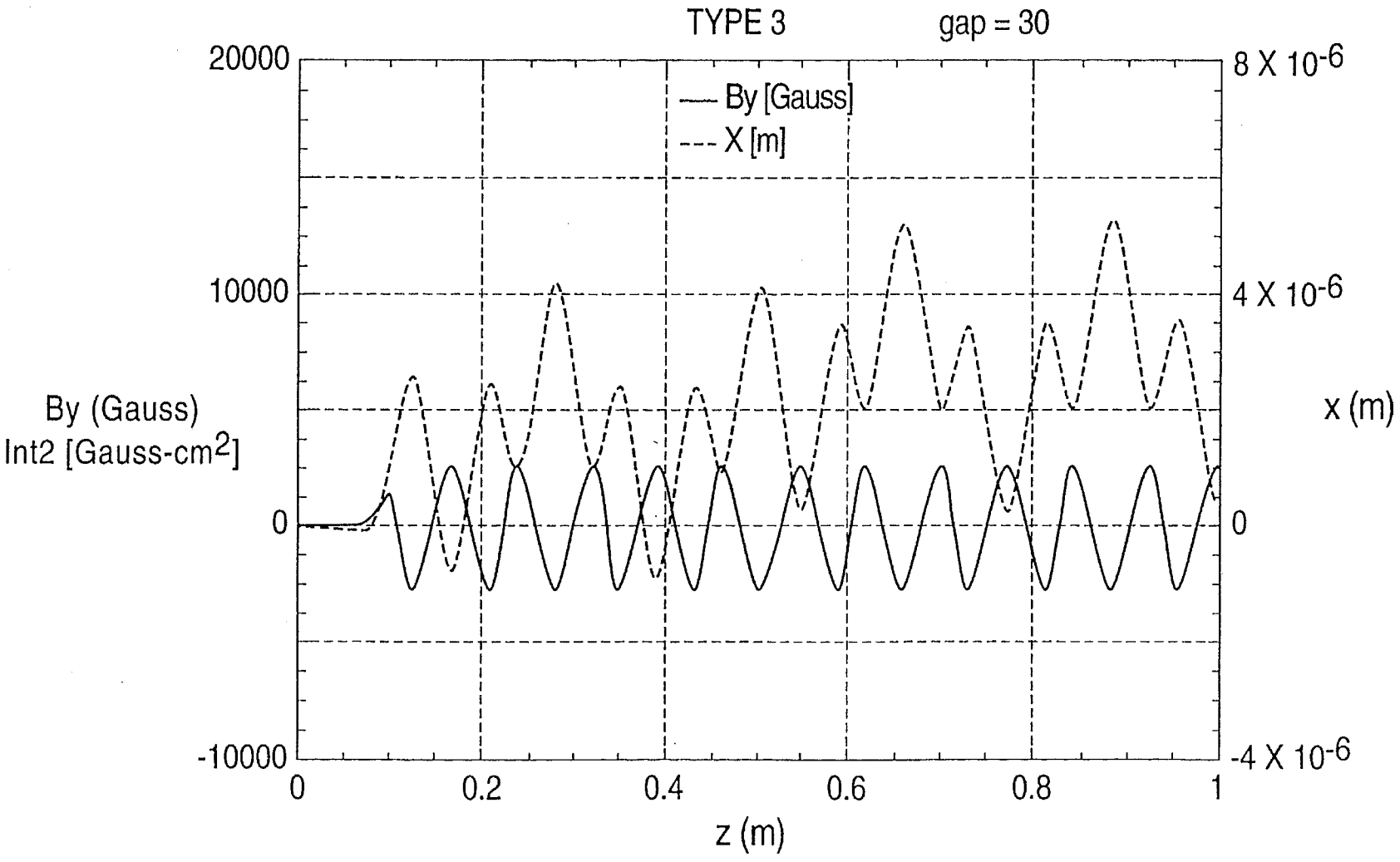
FIG. 20 illustrates a part of the magnetic field generated by the row of magnets shown in FIG. 19 and the double integral of the field (proportional to the electronic path)

FIG. 20 illustrates a part of the magnetic field generated by this magnetic circuit and the double integral values thereof (proportional to an electron path). It is to be noted in FIG. 20 that the scale along the vertical axis is sued commonly to the magnetic field By and the double integral values Int2. It can be read from FIG. 20 that the positions of peak values of the magnetic field and the positions of peak values of the double integral values in the direction of the array of the magnets or in the direction of z axis, satisfy the relation of the generalized Fibonacci series, that is, the magnetic fields is quasi-periodic by making the thickness of the isolated magnets shown in FIG. 19 to be 0.7 times thinner than the thickness of each magnet of the pair of the magnets. It is to be noted that gap=30 means that the gap between the upper magnet and the lower magnet is 30 mm as shown in FIG. 19.

Figure 21:
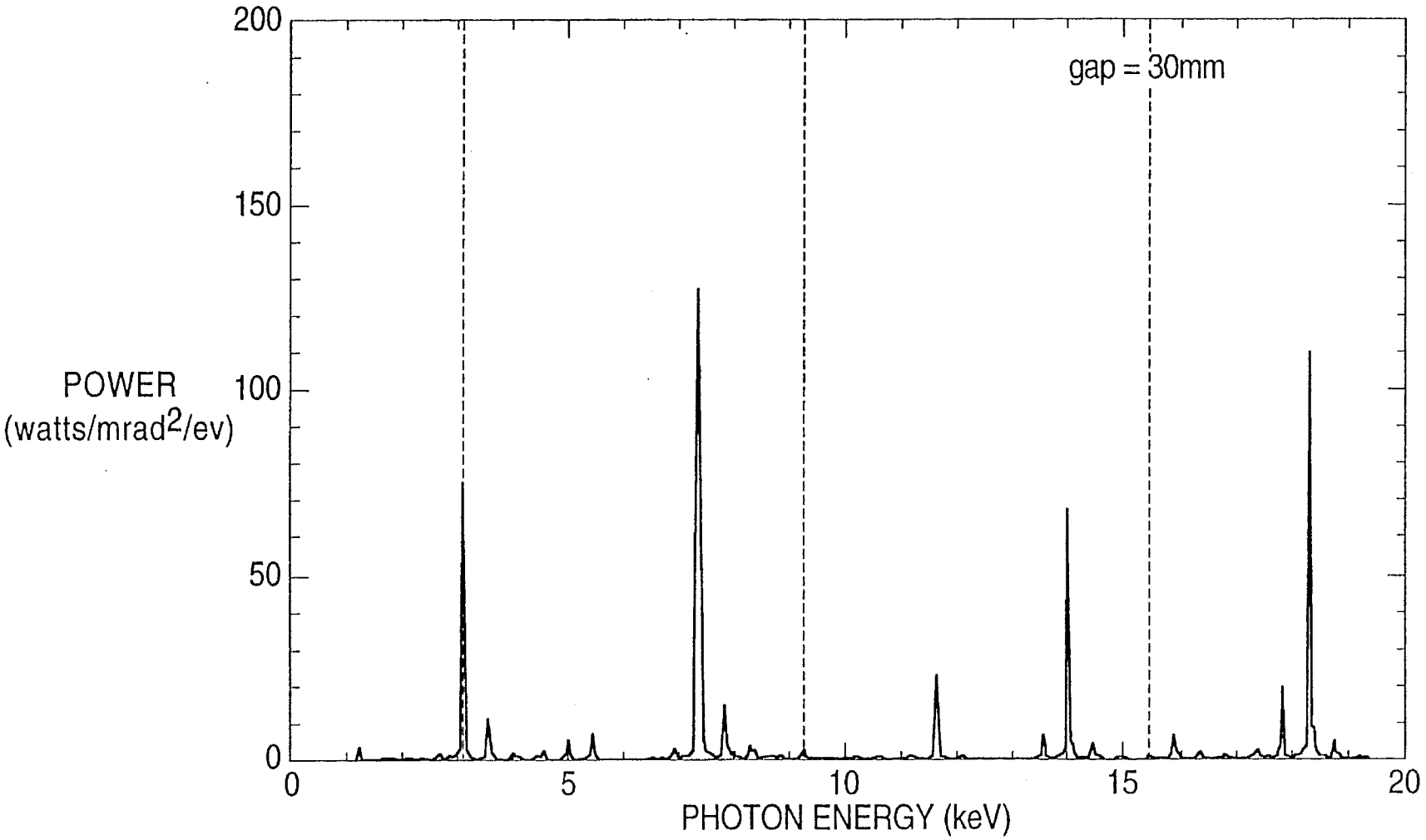
FIG. 21 illustrates the result of calculation of radiation spectrum from the quasi-periodic undulator having a 50-period magnetic circuit having the row of magnets as shown in FIG. 19.

FIG. 21 shows the result of calculation of the spectrum of the radiation from a quasi-periodic undulator having a 50-period magnetic circuit. Since the photon energy shown in the abscissa is proportional to the number of oscillations of the light or the frequency of the light, the abscissa can be associated to the frequency. The gap between the upper magnet and the lower magnet is 30 mm, the same as that of FIG. 20. It is also to be noted that when calculating the spectrum, the electronic energy and the current are assumed as 8 GeV and 100 mA, respectively. It is further to be noted that the total length of the undulator is 3.8 m. In the drawing, the peak on the dashed line positioned on the most left side is the first order wave or the fundamental wave and for the better understanding, dashed lines are written at the position of the higher harmonics of the third order, and the fifth order.

Figure 22:
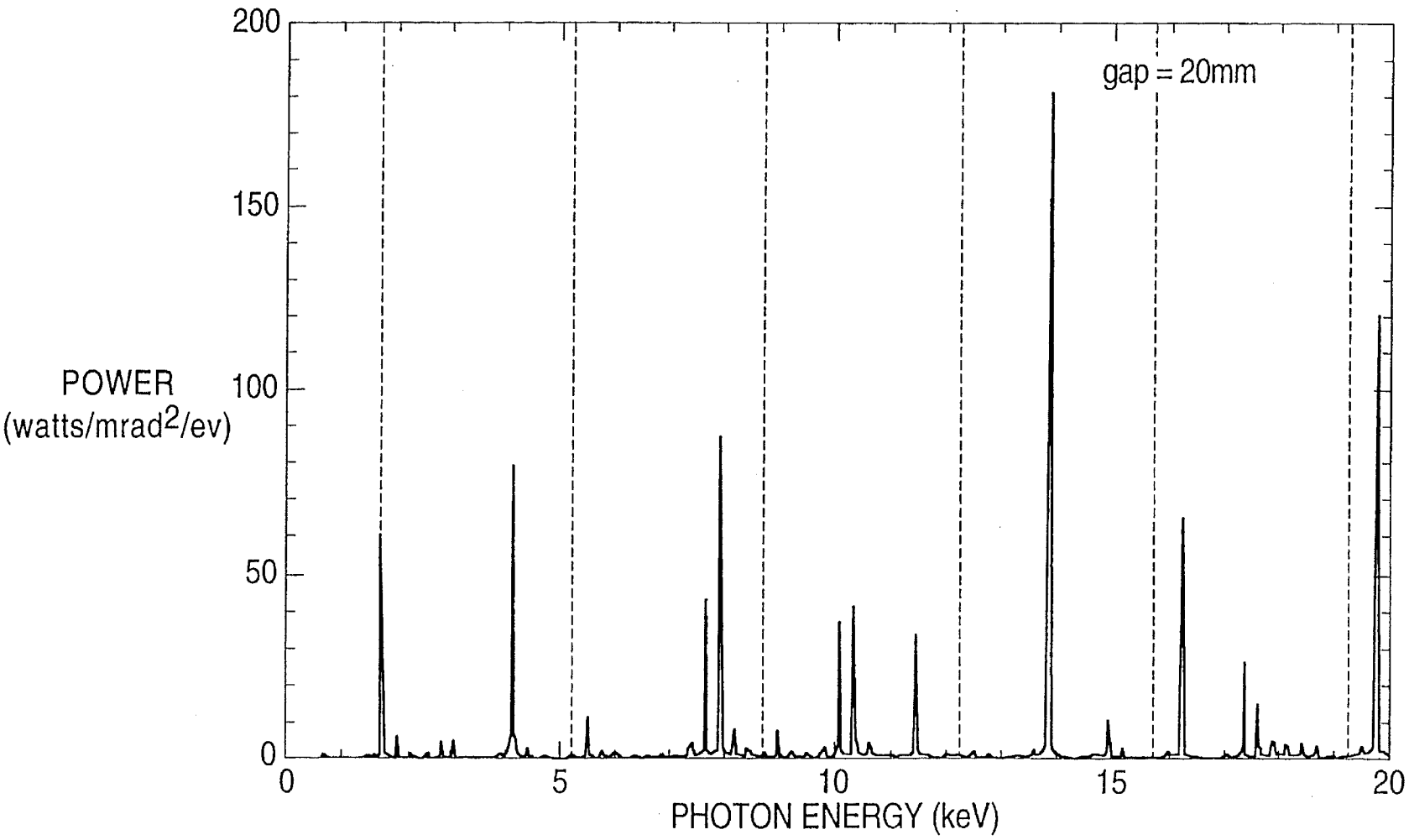
FIG. 22 illustrates the result of calculation of the radiation spectrum under the same condition as FIG. 21, except that the gap between the upper and lower magnets is varied.
Figure 23:
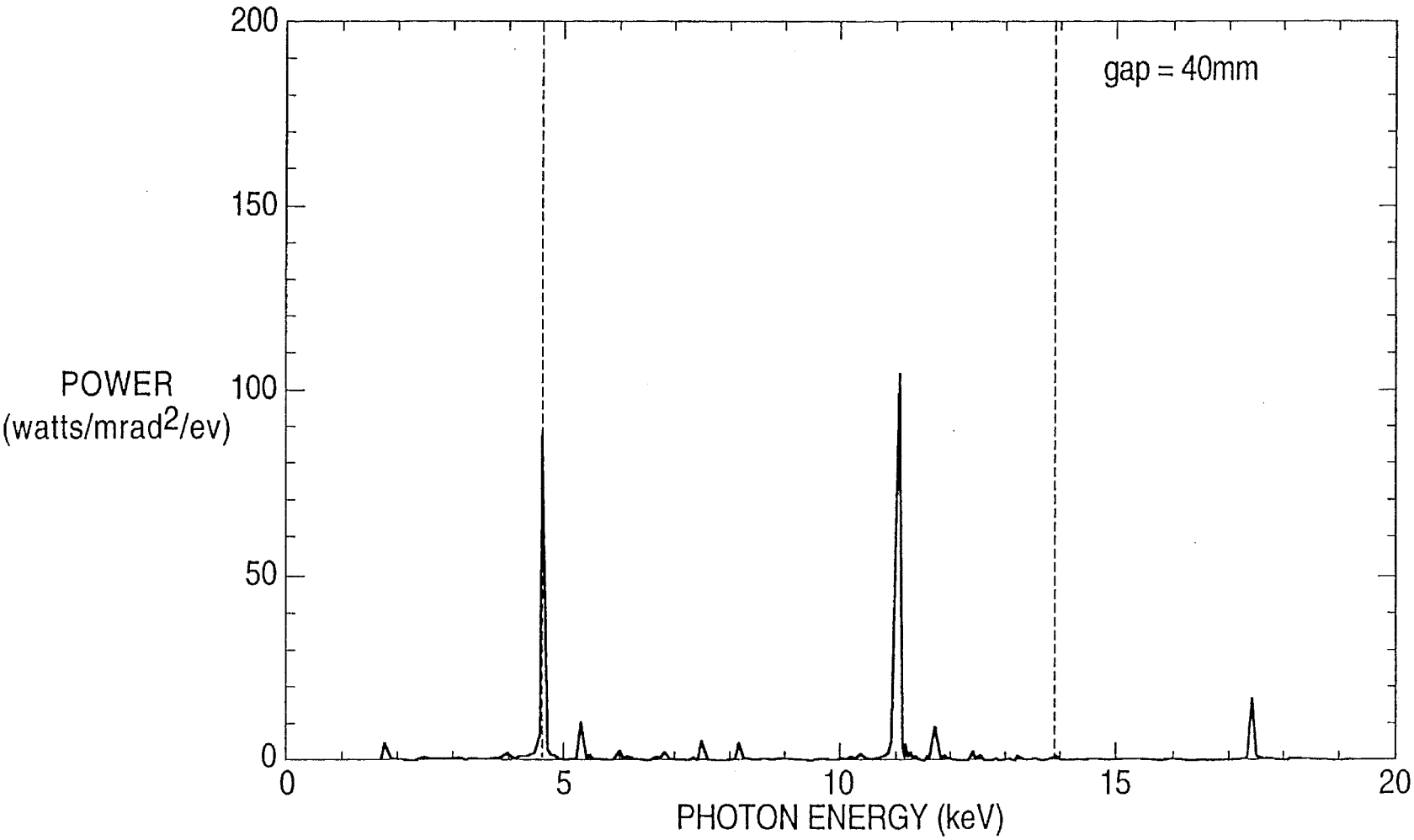
FIG. 23 illustrates another result of calculation of the radiation spectrum under the same condition as FIG. 21, except that the gap between the upper and lower magnets is varied.
Figure 24:
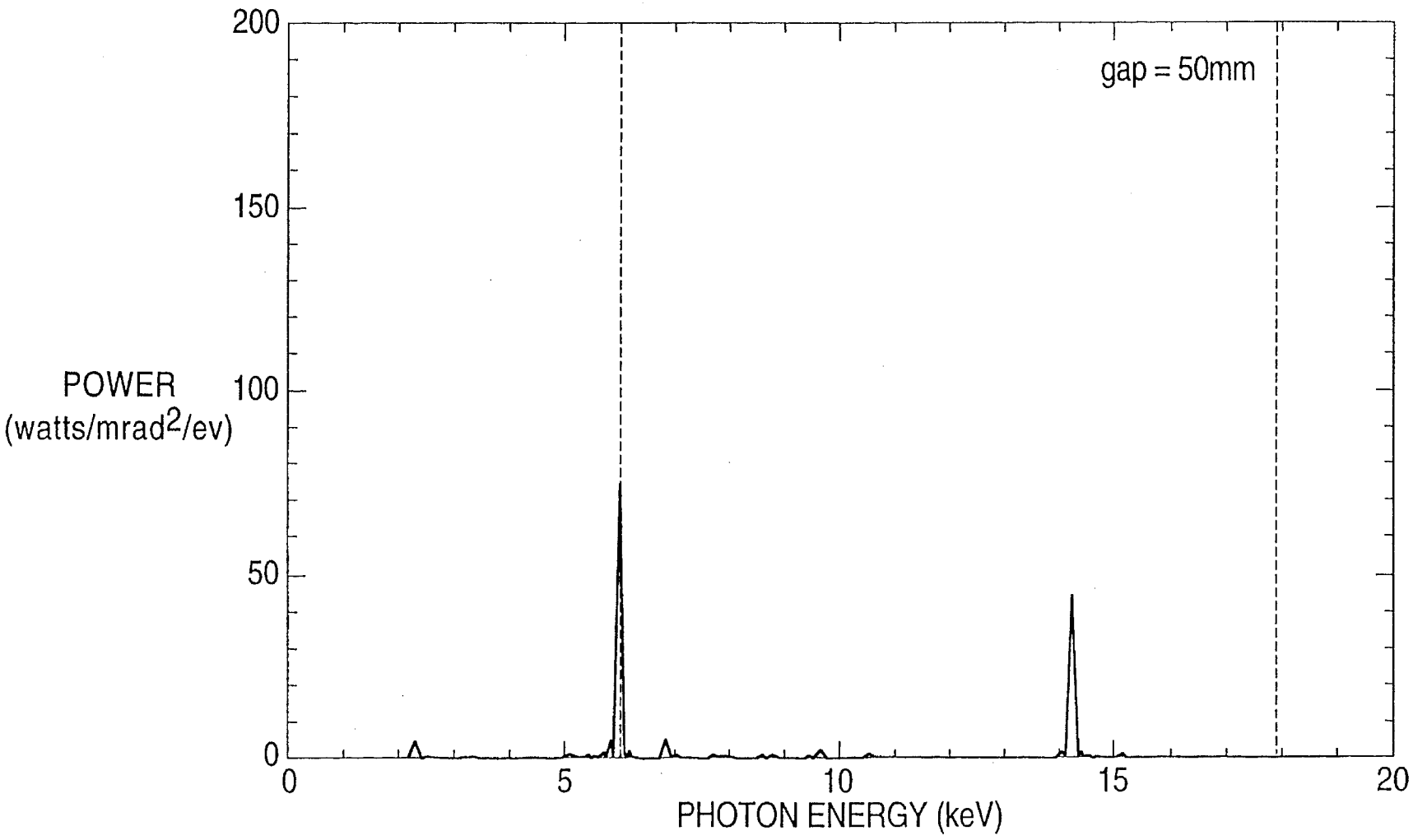
FIG. 24 illustrates a further result of calculation of the radiation spectrum under the same condition as FIG. 21, except that the gap between the upper and lower magnets is varied.

For reference, FIGS. 22 through 24 illustrate the results of calculation of the radiation spectrum when the gap between the upper and the lower magnets are varied under the same condition. In the drawings, dashed lines indicate the positions of odd-number-order-harmonic waves.

It can be read from FIGS. 21 through 24 that the odd-number-order-harmonic waves which are always generated according to a conventional undulator are not generated at all and the integer-order-harmonic waves are also not generated at all while the irrational-order-harmonic waves are generated.

It is also possible to generate only such irrational-order-harmonic waves can be generated by varying the intensity of the respective magnets with the thickness of the magnets being not equal.

It is also noted that the type of the magnet to be used may be a permanent magnet or an electromagnet, that is, that the present invention is not limited to the types of magnets.

The present invention has been described in detail with reference to a certain preferred embodiments thereof, but it will be understood that variations and modifications can be effected within the spirit and scope of the invention.

What is claimed is:

1. A magnetic field generating apparatus for use in an undulator as an insertion light source, wherein:

a plurality of magnetic poles provided by using magnets are arranged in opposition to one another in pairs;

said pairs of magnetic poles of the array of magnets are arranged with two kinds of intervals between the adjacent magnetic poles, said two intervals having the relation of an irrational number ratio in accordance with the order to substantially generalized Fibonacci series; and the series of peak values of the magnetic field along the central axis of the magnetic circuit comprising the array of the magnets reside at the positions to satisfy the relation of substantially generalized Fibonacci series.

2. A magnetic field generating apparatus for use in an undulator as an insertion light source, wherein;

a plurality of magnetic poles provided by using magnets are arranged in opposition to one another in pairs;

said pairs of magnetic poles of the array of magnets are arranged with two kinds of intervals between the adjacent magnetic poles, said two intervals having the relation of an irrational number ratio in accordance with the order of substantially generalized Fibonacci series; and the series of peak values of the double integral values of the magnetic field along the central axis of the magnetic circuit comprising of the array of the magnets reside at the positions to satisfy the relation of substantially generalized Fibonacci series.

* * * * *